US012729615B2

(12) United States Patent
Zhong et al.

(10) Patent No.: US 12,729,615 B2
(45) Date of Patent: Sep. 8, 2026

(54) PUMP SYSTEM, WELLSITE LAYOUT AND METHOD FOR CONTROLLING THE PUMP SYSTEM

(71) Applicant: YANTAI JEREH PETROLEUM EQUIPMENT & TECHNOLOGIES CO., LTD., Yantai (CN)

(72) Inventors: Jifeng Zhong, Yantai (CN); Liang Lv, Yantai (CN); Shouzhe Li, Yantai (CN); Jihua Wang, Yantai (CN); Xincheng Li, Yantai (CN); Yipeng Wu, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 15 days.

(21) Appl. No.: 18/904,942

(22) Filed: Oct. 2, 2024

(65) Prior Publication Data

US 2025/0027397 A1 Jan. 23, 2025

Related U.S. Application Data

(63) Continuation of application No. PCT/CN2022/113242, filed on Aug. 18, 2022.

(30) Foreign Application Priority Data

Apr. 27, 2022 (CN) ..... 202210451262.4

(51) Int. Cl.
*E21B 43/26* (2006.01)
*F04B 17/03* (2006.01)

(52) U.S. Cl.
CPC ..... *E21B 43/2607* (2020.05); *F04B 17/03* (2013.01)

(58) Field of Classification Search
CPC ..... E21B 43/2607; F04B 17/03
See application file for complete search history.

(56) References Cited

U.S. PATENT DOCUMENTS 9,745,840 B2 * 8/2017 Oehring ..... H02P 23/00
10,865,624 B1 12/2020 Cui et al.
(Continued)

FOREIGN PATENT DOCUMENTS

CA 2987665 A1 6/2018
CN 102602322 A 7/2012
(Continued)

OTHER PUBLICATIONS

Written Opinion of the International Searching Authority and International Search Report for PCT Application No. PCT/CN2019/107475 mailed on Jun. 22, 2020.
(Continued)

*Primary Examiner* — Shane Bomar
(74) *Attorney, Agent, or Firm* — Sheppard Mullin Richter & Hampton LLP

(57) ABSTRACT

A pumping system includes an electric fracturing device and multiple power supply systems. The electric fracturing device includes a plunger pump, a main motor for driving the plunger pump, and at least one auxiliary electric device. The multiple power supply systems include at least one main power supply and at least one auxiliary power supply. The main power supply supplies electric power to the main motor, and the auxiliary power supply supplies electric power to the at least one auxiliary electric device.

23 Claims, 15 Drawing Sheets

(56) References Cited

U.S. PATENT DOCUMENTS

| | | | | |
|---|---|---|---|---|
| 10,865,631 | B1 * | 12/2020 | Zhang | F04B 17/03 |
| 12,071,840 | B2 * | 8/2024 | Cui | F04D 29/605 |
| 2002/0023752 | A1 | 2/2002 | Qu et al. | |
| 2010/0032031 | A1 | 2/2010 | Neal | |
| 2010/0109324 | A1 | 5/2010 | Ben-david | |
| 2012/0060929 | A1 | 3/2012 | Kendrick | |
| 2012/0128424 | A1 * | 5/2012 | St. Clergy | E21B 33/138 405/129.25 |
| 2013/0140031 | A1 | 6/2013 | Cohen et al. | |
| 2013/0284455 | A1 | 10/2013 | Kajaria et al. | |
| 2014/0000899 | A1 | 1/2014 | Nevison | |
| 2014/0096974 | A1 | 4/2014 | Coli et al. | |
| 2014/0138079 | A1 | 5/2014 | Broussard et al. | |
| 2014/0174717 | A1 | 6/2014 | Broussard et al. | |
| 2014/0203760 | A1 | 7/2014 | Lammers et al. | |
| 2014/0251623 | A1 | 9/2014 | Lestz et al. | |
| 2015/0252661 | A1 * | 9/2015 | Glass | E21B 43/2607 166/308.1 |
| 2016/0032703 | A1 | 2/2016 | Broussard et al. | |
| 2016/0208592 | A1 | 7/2016 | Oehring | |
| 2016/0369609 | A1 * | 12/2016 | Morris | F04B 9/02 |
| 2019/0009232 | A1 | 1/2019 | Yeung | |
| 2019/0211661 | A1 | 7/2019 | Reckels et al. | |
| 2019/0353303 | A1 * | 11/2019 | Morris | F04B 17/03 |
| 2020/0088202 | A1 | 3/2020 | Sigmar et al. | |
| 2020/0263498 | A1 | 8/2020 | Fischer et al. | |
| 2020/0263527 | A1 | 8/2020 | Fischer et al. | |
| 2020/0263528 | A1 | 8/2020 | Fischer et al. | |
| 2020/0362855 | A1 * | 11/2020 | Beisel | F04B 1/0408 |
| 2020/0392826 | A1 | 12/2020 | Cui et al. | |
| 2020/0400005 | A1 | 12/2020 | Han et al. | |
| 2021/0095648 | A1 * | 4/2021 | Buckley | F04B 9/02 |
| 2023/0092506 | A1 * | 3/2023 | Zhong | E21B 43/26 166/177.5 |
| 2023/0412108 | A1 * | 12/2023 | Li | H02P 27/085 |

FOREIGN PATENT DOCUMENTS

| | | | |
|---|---|---|---|
| CN | 103758499 | A | 4/2014 |
| CN | 103912259 | A | 7/2014 |
| CN | 104153756 | A | 11/2014 |
| CN | 204402781 | U | 6/2015 |
| CN | 106574495 | A | 4/2017 |
| CN | 107159046 | A | 9/2017 |
| CN | 107208557 | A | 9/2017 |
| CN | 109882144 | A | 6/2019 |
| CN | 110118127 | A | 8/2019 |
| CN | 110152552 | A | 8/2019 |
| CN | 110155193 | A | 8/2019 |
| CN | 110201573 | A | 9/2019 |
| CN | 110821464 | A | 2/2020 |
| CN | 210598946 | U | 5/2020 |
| CN | 111355281 | A | 6/2020 |
| CN | 214887011 | U | 11/2021 |
| CN | 113922360 | A | 1/2022 |
| CN | 113969774 | A | 1/2022 |
| CN | 215719294 | U | 2/2022 |
| CN | 113852174 | B | 3/2024 |

OTHER PUBLICATIONS

Non-Final Office Action for U.S. Appl. No. 16/838,787 mailed on Jun. 2, 2020.

Written Opinion of the International Searching Authority and International Search Report for PCT Application No. PCT/CN2022/113242 mailed on Oct. 10, 2022.

International Preliminary Report on Patentability Chapter I for PCT Application No. PCT/CN2019/107475 mailed on Apr. 7, 2022.

Non-Final Rejection for U.S. Appl. No. 17/703,780 mailed on Sep. 15, 2023.

Non-Final Rejection for U.S. Appl. No. 17/703,780 mailed on Dec. 29, 2023.

Notice of Allowance for U.S. Appl. No. 17/703,780 mailed on Apr. 23, 2024.

First Search Report for Chinese Application No. 201910904510.4 mailed on Jan. 29, 2024.

First Search for Chinese Application No. 202210451262.4 mailed on Dec. 6, 2022.

Second Office Action for Chinese Application No. 201910904510.4 mailed on May 17, 2024.

* cited by examiner

PUMP SYSTEM, WELLSITE LAYOUT AND METHOD FOR CONTROLLING THE PUMP SYSTEM

CROSS-REFERENCE TO RELATED APPLICATIONS

This application is a continuation of International Patent Application No. PCT/CN2022/113242 filed Aug. 18, 2022, which claims the priority to and benefit of Chinese patent application No. 202210451262.4 filed with China National Intellectual Property Administration (CNIPA) on Apr. 27, 2022. The disclosure of all of the above applications is incorporated herein by reference in their entirety.

TECHNICAL FIELD

The present specification generally relates to the field for increasing the output of oil-gas field fracturing operation, specifically relates to a pumping system, a wellsite assembly and a method for controlling the pumping system.

BACKGROUND ART

The existing electric fracturing/pumping/cementing device in which an electric motor is used instead of a diesel engine generally includes: a plunger pump; an electric motor (a main motor) for driving the plunger pump; and other auxiliary electric devices such as a heat dissipation device (including an auxiliary motor for heat dissipation), a lubrication device (including an auxiliary motor for lubrication) and a control system. In addition to the above electric fracturing/pumping/cementing device, a power supply system for supplying electric power to the electric fracturing/pumping/cementing device is generally included in an existing pumping system or an existing wellsite assembly. For example, in a pumping system or a wellsite assembly for an electric fracturing operation, according to various operation conditions, the total power of electricity usage during the fracturing operation is generally 0~35 MW (megawatt), and the wellsite is usually equipped with a power supply system having a corresponding output power as the electric power source.

On the one hand, the power of electricity usage during a general fracturing operation is very large. Most of the wellsites of oil-gas field are located far away from cities and towns or power generation plants such that the power supply facility is inadequate and the wellsite has to run without a nearby power grid. Therefore, many wellsites need to be equipped with a power generation equipment so as to supply electric power to various electric devices in the wellsite. On the other hand, even if the existing wellsite adopts a power generation equipment as a power supply system, the following problem may arise. The power (for example, 35 MW) of each power generator with a large power is generally designed to satisfy the maximum demand of electricity usage in the wellsite, but an electric device with a large power (for example, 20 MW~30 MW) in the wellsite often operates intermittently (for example, during the fracturing operation, a continuous operating time with a large power is about two hours, while an idle interval period is tens of minutes and up to several hours). During the idle interval period within the fracturing operations, various auxiliary electric devices in the wellsite have a power of electricity usage of for example 0.2 MW~5 MW. While each power generator with a large power (which is, for example, a power of 35 MW) consumes a lot of fuel even though it is in a idle-speed state. Accordingly, the wellsite has a low efficiency of electricity usage and the economic factor is poor. In addition, although a combination mode in which multiple power supply systems (such as a power grid and a power generator) are adopted has been proposed, the existing multiple power supply systems lack an unified controlling and allocating mechanism, so that they cannot satisfy the operating conditions of the wellsite where a high-power load fluctuates. Thus, the power generator, during standby, would be operated with a high energy consumption and a low output, such that the difficulties in operation and usage are increased.

SUMMARY OF THE INVENTION

One aspect of the present specification is to provide a pumping system including an electric fracturing device which is powered by multiple power supply systems (two or more power supply systems). The present specification can solve the problem in the prior art where a single power supply system is employed to supply electric power but a normal operation of the electric fracturing device cannot be guaranteed if the single power supply system fails. Furthermore, by additionally adopting an auxiliary power source system, the present specification can supply electric power more efficiently and flexibly during the intervals in the fracturing operation, and thus the problem of the prior art where a single power supply system cannot satisfy the demand of electricity usage for the auxiliary electric devices is solved.

Another aspect of the present specification is to provide a pumping system including an electric pumping device which is powered by multiple power supply systems (two or more power source systems). Still another aspect of the present specification is to provide a pumping system including an electric cementing device which is powered by multiple power supply systems (two or more power supplies). Still another aspect of the present specification is to provide a wellsite assembly including any one of the pumping systems disclosed herein. Still another aspect of the present specification is to provide a method for controlling the pumping systems disclosed herein.

A pumping system according to one embodiment of the present specification includes an electric fracturing device and multiple power supply systems. The electric fracturing device includes: a plunger pump; a main motor for driving the plunger pump; and at least one auxiliary electric device. The multiple power supply systems supply electric power to the electric fracturing device. Herein, the multiple power supply systems include at least one main power supply and at least one auxiliary power supply. The main power supply supplies electric power to the main motor, and the auxiliary power supply supplies electric power to the at least one auxiliary electric device. In this case, a working fluid of the electric fracturing device is a fracturing liquid, and the plunger pump pressurizes and then transports the fracturing liquid to the underground so as to fracture the formation.

A pumping system according to one embodiment of the present specification may alternatively or additional include an electric pumping device, wherein a working fluid of the electric pumping device is a pumping liquid, and the plunger pump pressurizes the pumping liquid and then transports it to a downhole so as to pump or drive a downhole tool.

A pumping system according to one embodiment of the present specification may alternatively or additional include an electric cementing device, wherein a working fluid of the electric cementing device is a cement paste, and the plunger pump pressurizes the cement paste and then transports it to at least one mineshaft so as to fix a wall of the mineshaft.

A wellsite assembly according to one embodiment of the present specification includes any one of the above pumping systems. When the main power supply and/or the auxiliary power supply adopts a fuel to generate electric power, the wellsite assembly further includes a transport device for transporting the fuel and a process device for processing the fuel. Depending on the source or type of the adopted fuel, the process device includes at least one of a gas fuel pressure-regulating device, a liquid fuel gasification device, or a fuel purification device.

A wellsite assembly according to one embodiment of the present specification includes any one of the above pumping systems, and further includes a fluid preparing region. The fluid preparing region includes: a sand blender communicating with a fluid inlet of the plunger pump; a sand supplying device for supplying sand to the sand blender; and a liquid supplying device for supplying liquid to the sand blender. The sand blender mixes the sand from the sand supplying device with the liquid from the liquid supplying device, so as to obtain a working fluid and supply it to the fluid inlet of the plunger pump.

A wellsite assembly according to one embodiment of the present specification includes any one of the above pumping systems, wherein the plunger pump of each of a plurality of the electric fracturing/pumping/cementing devices is provided with a fluid feeding manifold communicating with the fluid inlet of the plunger pump itself and has respectively a fluid outlet. The fluid outlets of the plunger pumps share a fluid discharging manifold communicating with a wellhead. In some embodiments, the fluid feeding manifolds and the fluid discharging manifold may be integrated on at least one manifold-integrating equipment.

A wellsite assembly according to one embodiment of the present specification includes any one of the above pumping systems, and further includes: an instrumentation apparatus and a centralized control system provided in the instrumentation apparatus; a control system provided in the main power supply; a control system provided in the auxiliary power supply; a control system provided in the electric fracturing/pumping/cementing device; a power distribution apparatus and a control system provided in the power distribution apparatus, wherein the main power supply and the auxiliary power supply electric power to the electric fracturing/pumping/cementing device via the power distribution apparatus; a video system for capturing a video in a wellsite; and a sensor system for acquiring an environmental parameter in the wellsite. Each of the sensor system, the video system, the control system in the power distribution apparatus, the control system in the electric fracturing/pumping/cementing device, the control system in the auxiliary power supply and the control system in the main power supply feeds information to the centralized control system and is provided with a control signal by the centralized control system.

A method for controlling a pumping system according to one embodiment of the present specification is provided, wherein, the pumping system includes an electric fracturing/pumping/cementing device and multiple power supply systems. The electric fracturing/pumping/cementing device includes: a plunger pump; a main motor for driving the plunger pump; and at least one auxiliary electric device. The multiple power supply systems supply electric power to the electric fracturing/pumping/cementing device, and includes at least one main power supply and at least one auxiliary power supply. The method for controlling the pumping system includes: supplying electric power to the main motor by using the main power supply, and supplying electric power to the at least one auxiliary electric device by using the auxiliary power supply.

The embodiments of the present specification have at least the following advantageous effects:

(1) ESG (Environment, Society and Governance) advantages: the main power supply and/or the auxiliary power supply of the present specification may adopt power-generating equipment(s). The present specification may use natural gas in all of the power-generating equipment(s), and the main power-generating equipment may be on standby in the idle interval of the fracturing operation. Thus, it is possible to reduce the cost and the emission during standby.

(2) An electricity usage is more flexible and more efficient. In the interval of the fracturing operations, the auxiliary power supply of the present specification can satisfy electric demands of the auxiliary electric systems such as an air conditioning system, an illuminating system, a lubricating system and a control system (these auxiliary electric systems are electric devices with a small power (for example, 0~5 MW)) with a higher efficiency of electricity usage. As compared to the solution of the prior art in which single power supply is adopted, it is possible to guarantee the flexibility and high efficiency of electricity usage of the auxiliary electric systems.

(3) A power supply during a construction process is more reliable. The present specification uses the auxiliary power supply to continuously supply electric power to the auxiliary electric systems, so that even if the main power-generating equipment fails suddenly, the auxiliary power supply can still guarantee the normal operation of the auxiliary electric systems. Thus, it is possible to avoid the risk of losing control.

(4) The operation of a turbine is safer. Unlike the conventional "black start" operation, among the two power supplies of a power supply system of the present specification, the auxiliary power supply for supplying electric power to a turbine power-generating equipment (main power-generating equipment) will not stop supplying electric power after the turbine is started. Thus even when the turbine is stopped unusually, the auxiliary power supply can respond to the electric power demand of the turbine at any time, and it is possible to prevent the turbine from being damaged.

(5) In some embodiments, the present specification provides a solution in which the main power supply supplies electric power to the auxiliary electric devices after the electric power is adjusted by a transformer. Thus, there are more channels for supplying electric power, and the stability for supplying electric power is higher.

DETAILED DESCRIPTION OF EMBODIMENTS

Hereinafter, embodiments of the present specification would be described with reference to the drawings. The description would be given in the following order.

1. a pumping system including an electric fracturing device which is powered by multiple power supply systems according to embodiments of the present specification (with reference to FIG. 2A to FIG. 2E).

2. a power supply path achieved by using a switch cabinet trailer (with reference to FIG. 3 to FIG. 5B).

3. an integrated electric fracturing device and a power supply circuit thereof (with reference to FIG. 6 to FIG. 9).

Figure 10:
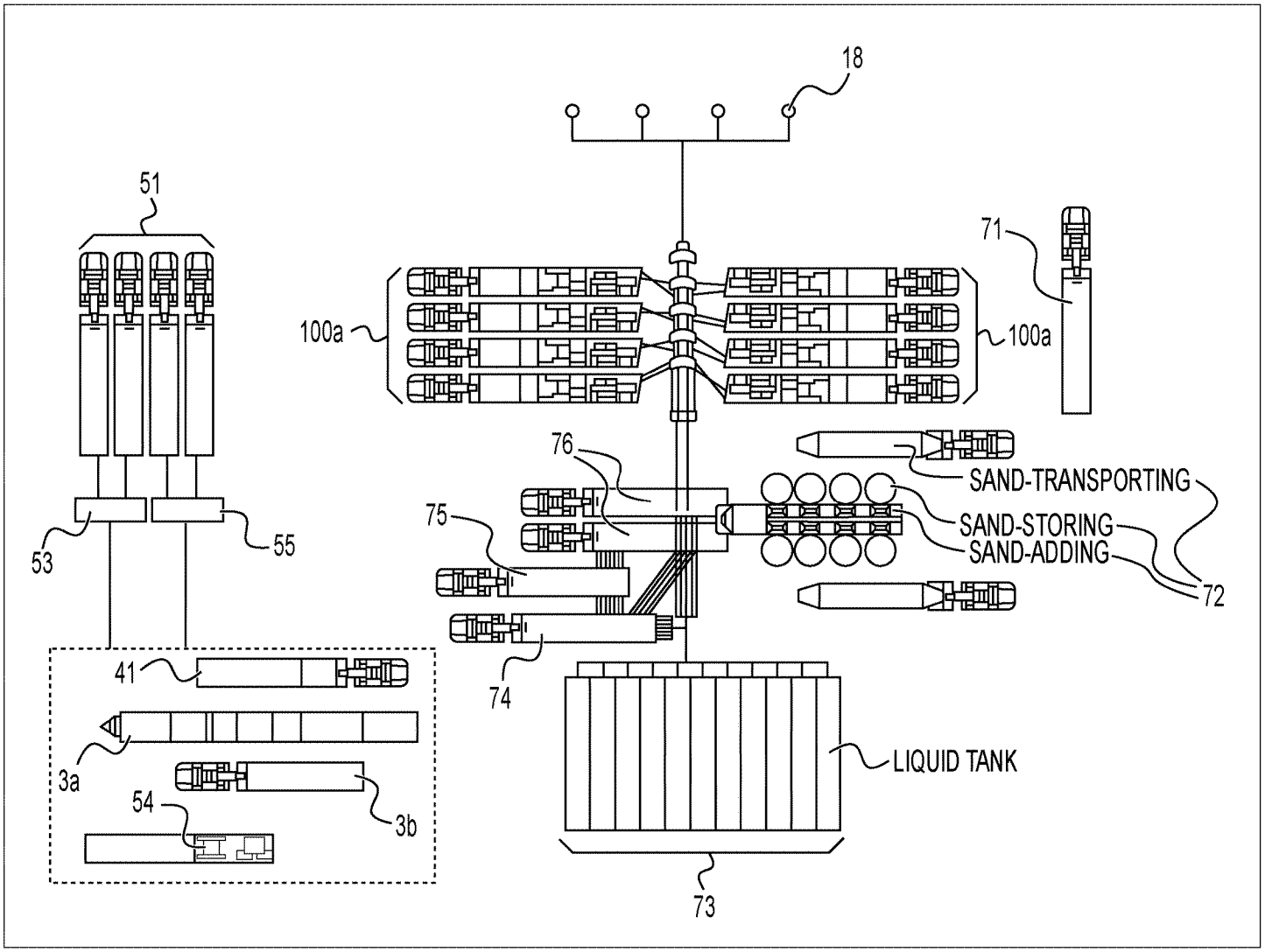
FIG. 10 is a diagram illustrating a wellsite assembly including a plurality of electric fracturing devices according to one embodiment of the present specification.
Figure 11:
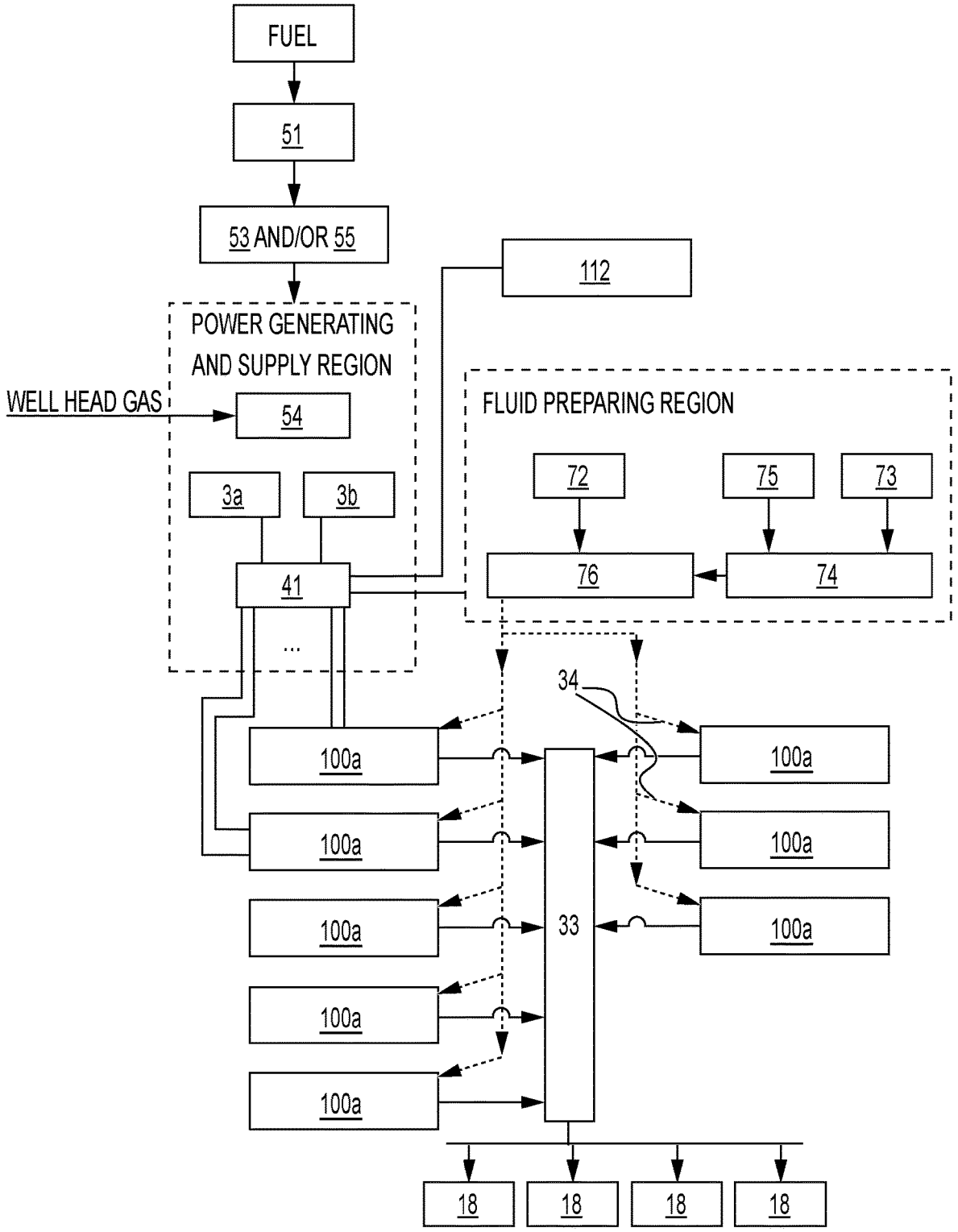
FIG. 11 is a schematic block diagram corresponding to the wellsite assembly as shown in FIG. 10.
Figure 12:
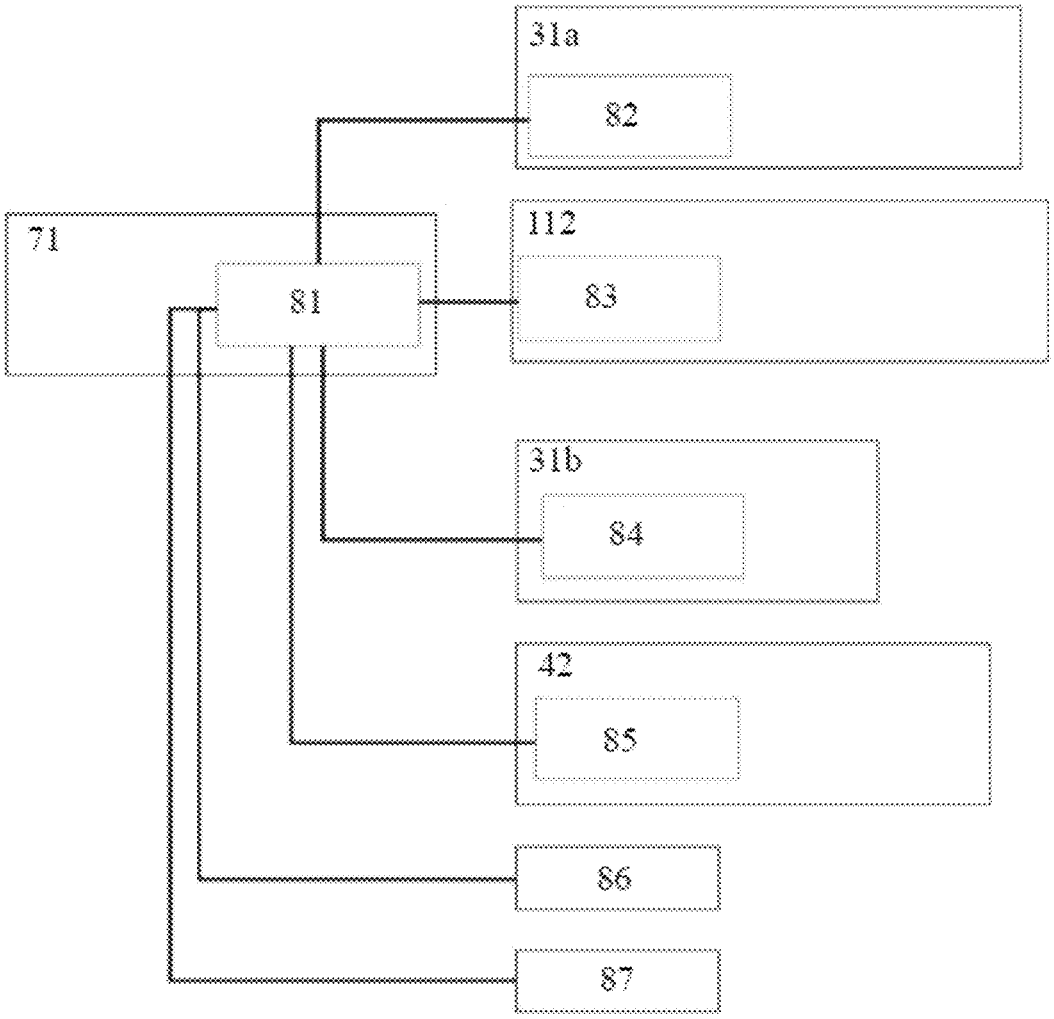
FIG. 12 shows a diagram of various control systems in the wellsite assembly according to one embodiment of the present specification.

4. a wellsite assembly and control systems thereof (with reference to FIG. 10 to FIG. 12).

Figure 13:
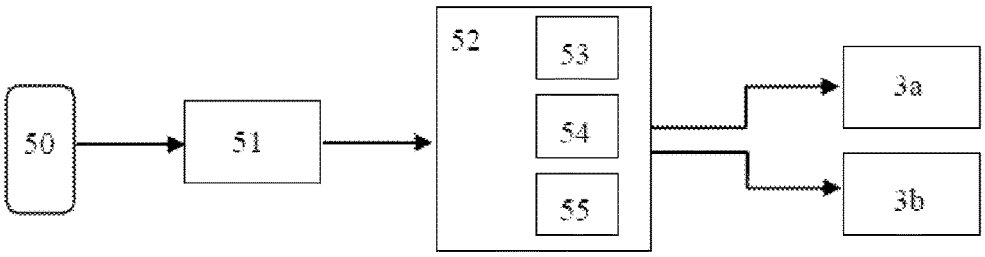
FIG. 13 shows a schematic block diagram of supply paths for supplying a fuel to a power generator according to one embodiment of the present specification.
Figure 14:
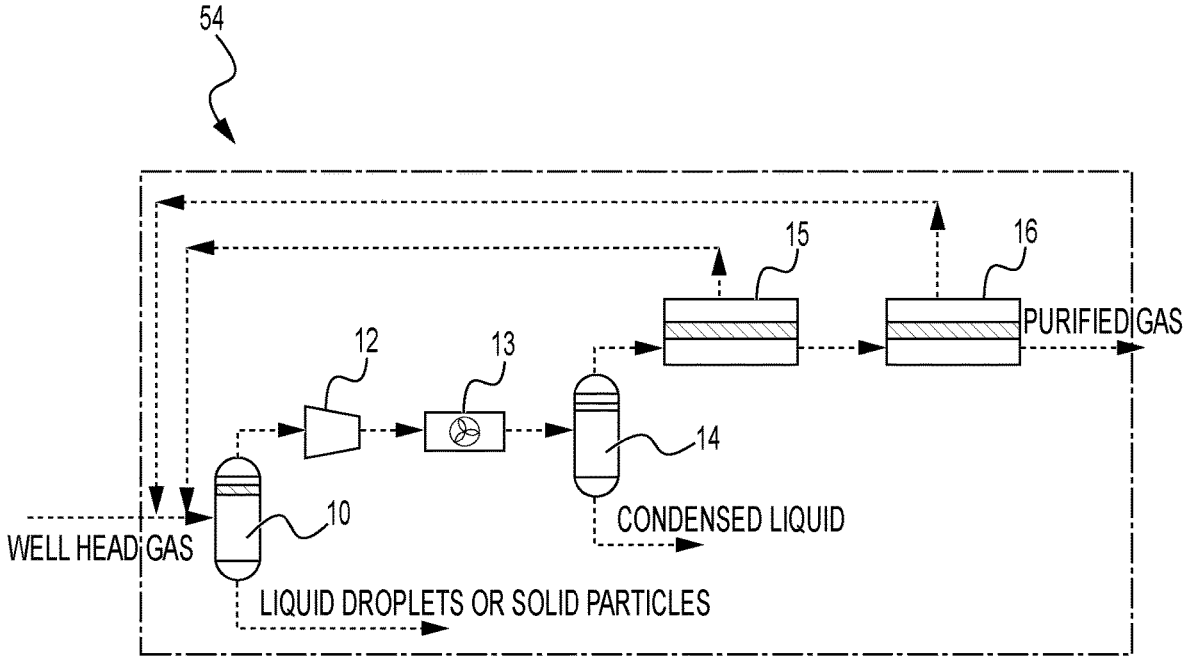
FIG. 14 is a diagram showing a configuration example of a purifying equipment used in the process device as shown in FIG. 13.

5. fuel supply and fuel process (with reference to FIG. 13 to FIG. 14).

In the following, the overview of the prior art is firstly described.

Figure 1:
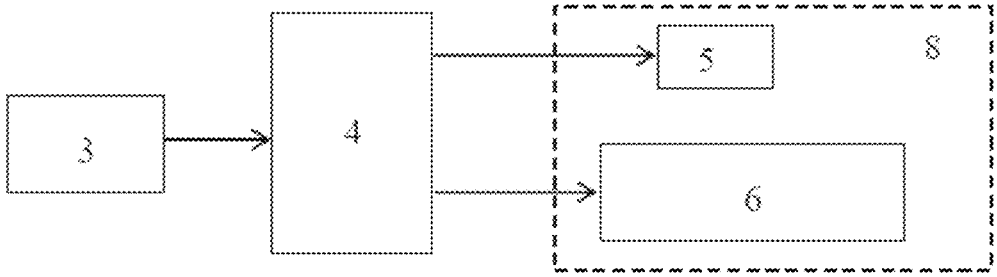
Prior Art Fig. 1
FIG. 1 is a block diagram of an example of a pumping system including an electric fracturing device which is powered by a single power supply system according to the prior art.

FIG. 1 is a block diagram of an example of a pumping system including an electric fracturing device which is powered by a single power supply system.

In FIG. 1, a power supply system 3 supplies a voltage to a power distribution system 4, and the voltage is distributed to a main motor 5 and at least one auxiliary electric device 6 in an electric fracturing device 8 via the power distribution system 4. The main motor 5 is used for driving a plunger pump (not shown) in the electric fracturing device 8. The at least one auxiliary electric device 6, for example, is a motor for heat dissipating, a motor for lubricating, a control system and the like in the electric fracturing device 8.

According to the pumping system including an electric fracturing device which is powered by a single power supply system as shown in FIG. 1. The prior art generally adopts a single power supply system which supplies electric power to the main motor in the electric fracturing device and also supplies electric power to other auxiliary electric devices in the electric fracturing device. Therefore, a efficiency of electricity usage is low and the economy is poor, which cannot satisfy the electric demand of the auxiliary electric devices.

[1. A Pumping System Including an Electric Fracturing Device which is Powered by Multiple Power Supply Systems According to Embodiments of the Present Specification.]

Figure 2A:
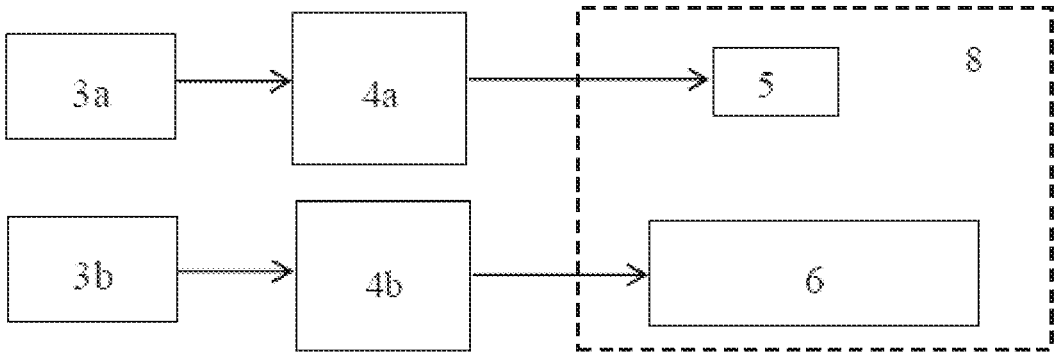
FIG. 2A is a block diagram of a pumping system including multiple power supply systems according to one embodiment of the present specification.

FIG. 2A is a first example of the pumping system adopting multiple power supply systems according to one embodiment of the present specification. In FIG. 2A, a main power supply system 3*a* (which, for example, can provide a high voltage of 10 kV or more) supplies electric power to the main motor 5 in the electric fracturing device 8 via a main power distribution system 4*a*, and an auxiliary power supply system 3*b* (which, for example, can provide a low voltage less than 1 kV) supplies electric power to the at least one auxiliary electric device 6 in the electric fracturing device 8 via an auxiliary power distribution system 4*b*. Examples of the at least one auxiliary electric device 6 include (but not limited to): a control system; an air conditioning system for refrigerating and heating (which includes an auxiliary motor such as a compressor motor, a fan motor, a wind-guiding motor, a coolant pump motor); a lubricating system (which includes an auxiliary motor for driving a lubrication oil pump); an illuminating system; a sensor system; a VFD (variable-frequency driving) system for driving each of auxiliary motors, and the like. Each of auxiliary motors can be employed to achieve a function such as heat dissipation, lubrication, refrigeration, heating or the like by driving a compressor, a fan, or a pump component such as a coolant pump or a lubrication oil pump.

The main power supply system 3*a* may adopt a power supply system with a large power, which may include at least one of a power grid and a power generator. The output power of the power supply system with a large power may be ranged in 3 MW~60 MW. The power generator may use a water power, a wind power, a steam or the like, or may be a power generator using a fuel (for example, in the present specification, a gas turbine power generator). For the power generator using fuel, the fuel may be a solid fuel, a liquid fuel, a gas fuel or a combination thereof. The fuel is transported from a dedicated fuel supply hub, and is stored, processed and supplied to the power generator using fuel. As one example, the main power supply system 3*a* may be a main power-generating equipment, which may include one or more power generators. The power of each power generator included in the main power-generating equipment is generally 3 MW or more. In some embodiments, the power provided by the combination of one or more power generators may be in a range of 3 MW~60 MW, and the voltage may be 10 kV or more, so as to satisfy a demand of large-scale electricity usage in the fracturing wellsite. In some embodiments, the main power-generating equipment may be a gas turbine power generator of 35 MW. The main power-generating equipment may include the combination of at least one power generator and an energy storing device, a combination of a plurality of power generators of 5 MW and an energy storing device, or a combination of one power generator of 35 MW and an energy storing device. By such combinations, the main power-generating equipment has more power supply channels and is more flexible in power supply. The energy storing device can store a part of electric power from the power generator, thereby achieving an optimum power supply efficiency. The energy storing device include one or more energy storage units. Examples of the energy storage units include: a chemical battery such as a sodium-ion battery and a lithium-ion battery; a supercapacitor; or a hydrogen fuel battery.

The auxiliary power supply system 3*b* may adopt a power supply system with a small power, which may include at least one of an internal combustion engine (for example, a piston-type internal combustion engine or a gas turbine) power-generating equipment, a power grid at the surrounding of a wellsite, an energy storing device, and a solar power panel. The output power of the power supply system with a small power may be 0.2 MW or more and 5 MW or less. The internal combustion engine power-generating equipment includes an internal combustion engine and a power generator driven by the internal combustion engine so as to generate an electric power. The internal combustion engine may be a diesel engine, a gas engine, a gas turbine engine, or a hydrogen fuel engine and the like. Further, the fuel type includes a fuel oil, a natural gas, a methyl alcohol, a hydrogen, a mixture containing hydrogen (e.g., a mixture of the natural gas and the hydrogen, and the like), a mixture of gaseous and liquid fuels and the like. In one embodiment, the auxiliary power supply system 3*b* may be an auxiliary power-generating equipment, which may be connected to a plurality of respective auxiliary electric devices via a plurality of switches. In some embodiments, the auxiliary power-generating equipment may be one power generator or may be a combination of a plurality of power generators. The auxiliary power-generating equipment may generally include two or less generators. Each of the power generators included in the auxiliary power-generating equipment may have a power not exceeding 5 MW, and the supply voltage therefrom may be lower than 1 kV. In some embodiments, the auxiliary power-generating equipment may adopt a power generator driven by a plurality of internal combustion engines. In some embodiments, the auxiliary power-generating equipment may be a combination of at least one power generator (e.g., an internal combustion engine power generator of 0.5 MW) and an energy storing device. Such combination can be similar to the aforementioned main power-generating equipment.

Since the auxiliary power supply system is adopted to supply electric power to at least one auxiliary electric device, a more flexible and more efficient electricity usage is obtained, as compared to the prior art in which only a single power supply system is adopted.

Figure 2B:
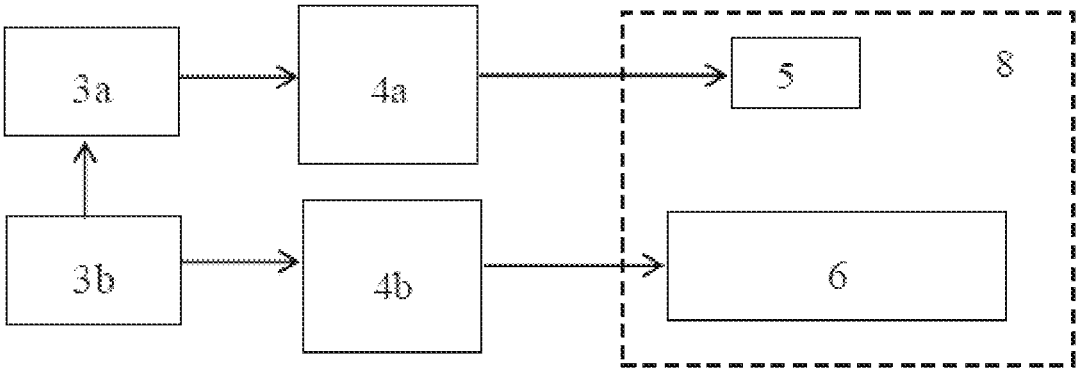
FIG. 2B is a block diagram of a pumping system including multiple power supply systems according to one embodiment of the present specification.
Figure 2C:
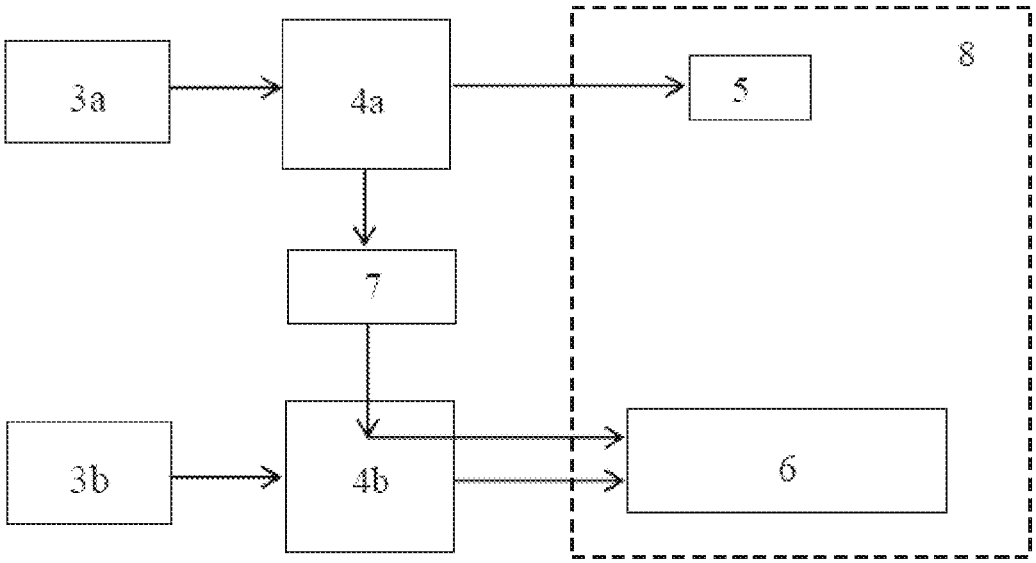
FIG. 2C is a block diagram of a pumping system including multiple power supply systems according to one embodiment of the present specification.
Figure 2D:
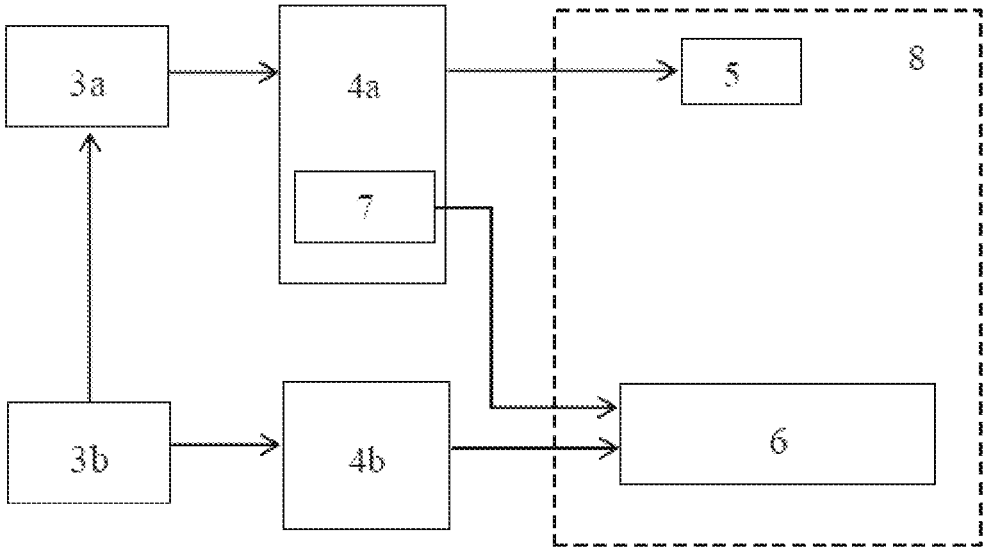
FIG. 2D is a block diagram of a pumping system including multiple power supply systems according to one embodiment of the present specification.

FIG. 2B is a second example of the pumping system adopting multiple power supply systems according to one embodiment of the present specification. FIG. 2C is a third example of the pumping system adopting multiple power supply systems according to one embodiment of the present specification. FIG. 2D is a fourth example of the pumping system adopting multiple power supply systems according to one embodiment of the present specification.

The second example as shown in FIG. 2B differs from that of FIG. 2A in that, in addition to supplying electric power to at least one auxiliary electric device 6 in the electric fracturing device 8, the auxiliary power supply system 3*b* supplies electric power to the main power supply system 3*a*, which may replace the traditional "black start" operation. The traditional "black start" operation means that when the main power supply system 3*a* is a gas turbine power generator, the gas turbine power generator must be equipped with a mini power-generating equipment, which is generally used for the startup, heat dissipation, lubrication and the like of the gas turbine power generator. A gas turbine power generator without self-start ability started by this mini power-generating equipment in a case of wellsite event of power outage and the like is called "black start". Generally, such a mini power-generating equipment does not continuously work, and thus cannot utilize a continuous power supply of the auxiliary power supply system 3*b* so as to satisfy the electric power demand such as the startup, heat dissipation and lubrication and the like of the main power supply system 3*a* at any time. Thus, the second example of the present specification can make the operation of the main power supply system 3*a* more convenient and safer.

The third example as shown in FIG. 2C differs from FIG. 2A in that, in addition to supplying electric power to the main motor 5 in the electric fracturing device 8, the main power supply system 3*a* can also supply electric power to at least one auxiliary electric device 6 in the electric fracturing device 8 via a transformer 7 for performing a voltage reduction. According to the third example of the present specification, the two-path power supplying mode with respect to at least one auxiliary electric device 6 are implemented. Thus, even if one path of the two-path power supplying mode (the main power supply system or the auxiliary power supply system) fails, another path of the two-path power supplying mode (the auxiliary power supply system or the main power supply system) can still guarantee the normal operation of the auxiliary electric device. Thus, power supplying channels are more, and the power supplying is more stable and more reliable. An on/off switch may be provided between the transformer 7 and the at least one auxiliary electric device 6. By using this on/off switch, it can enable that supplying electric power to the at least one auxiliary electric device 6 from an auxiliary power supply 3*b* takes priority to supplying electric power to the at least one auxiliary electric device 6 from the main power supply 3*a*.

The fourth example as shown in FIG. 2D is obtained by combing FIG. 2B with FIG. 2C. Note that, in a case where the voltage is regulated by using the transformer 7 (in a case of voltage regulation), the position of the transformer 7 may be different. For example, in the third example as shown in FIG. 2C, the transformer 7 is located and separately provided between the main power distribution system 4*a* and the auxiliary power distribution system 4*b*; but in the fourth example as shown in FIG. 2D, the transformer 7 is integrated in the main power distribution system 4*a*. Of course, according to the actual design demands of the wellsite, the transformer 7 may be integrated in the auxiliary power distribution system 4*b*, or may be directly connected between the main power supply system 3*a* and the at least one auxiliary electric device 6, or directly connected between the main power distribution system 4*a* and the at least one auxiliary electric device 6. Furthermore, the transformer 7 may be at the upstream of the at least one auxiliary electric device 6 and integrated together with the corresponding auxiliary electric device 6. The installation position of the transformer 7 of the present specification is not limited to the above examples. The fourth example according to the present specification has advantages of the above second and third examples.

Figure 2E:
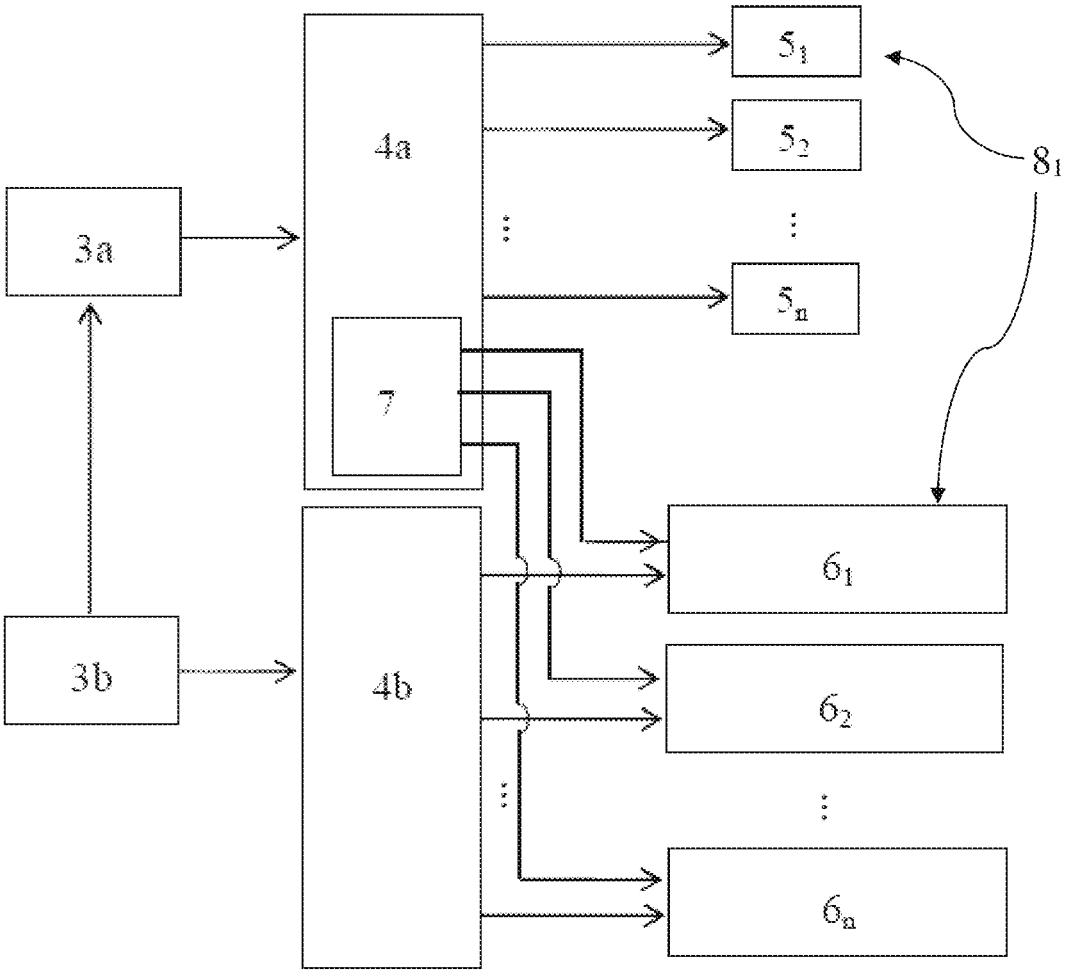
FIG. 2E is a block diagram of a pumping system including multiple power supply systems according to one embodiment of the present specification.

FIG. 2E is a fifth example of the pumping system adopting multiple power supply systems according to one embodiment of the present specification. The fifth example as shown in FIG. 2E differs from FIG. 2D in that, one electric fracturing device in the pumping system of FIG. 2D is replaced with a plurality of electric fracturing devices. Specifically, both the main power supply system 3*a* and the auxiliary power supply system 3*b* are used for supplying electric power to the plurality of electric fracturing devices $\mathbf{8}_1$~$\mathbf{8}_n$ (not shown). Each of the plurality of electric fracturing devices $\mathbf{8}_1$~$\mathbf{8}_n$ includes: main motors $\mathbf{5}_1$~$\mathbf{5}_n$; and auxiliary electric devices $\mathbf{6}_1$~ $\mathbf{6}_n$ correspondingly provided with respect to the main motors $\mathbf{5}_1$~$\mathbf{5}_n$. According to the fifth example of the present specification, since the plurality of electric fracturing devices are provided, an optional quantity of the electric fracturing devices may be combined so as to operate in one wellhead or a plurality of wellheads. Even if a certain electric fracturing device fails, other electric fracturing devices can still operate. Thus it is possible to improve the efficiency of the fracturing operation.

The multiple power supply systems of the present specification include two or more power supply systems. Although FIG. 2A to FIG. 2E only show two power supply systems of the main power supply system 3*a* and the auxiliary power supply system 3*b*, each of the main power supply system 3*a* and the auxiliary power supply system 3*b* is not limited to one. The present specification can fully guarantee the normal operation of the electric fracturing device and improves the flexibility and efficiency of electricity usage by adopting the power supply mode of the multi power supply systems.

[2. A Power Supply Path Achieved by Using a Switch Cabinet Trailer]

Figure 3:
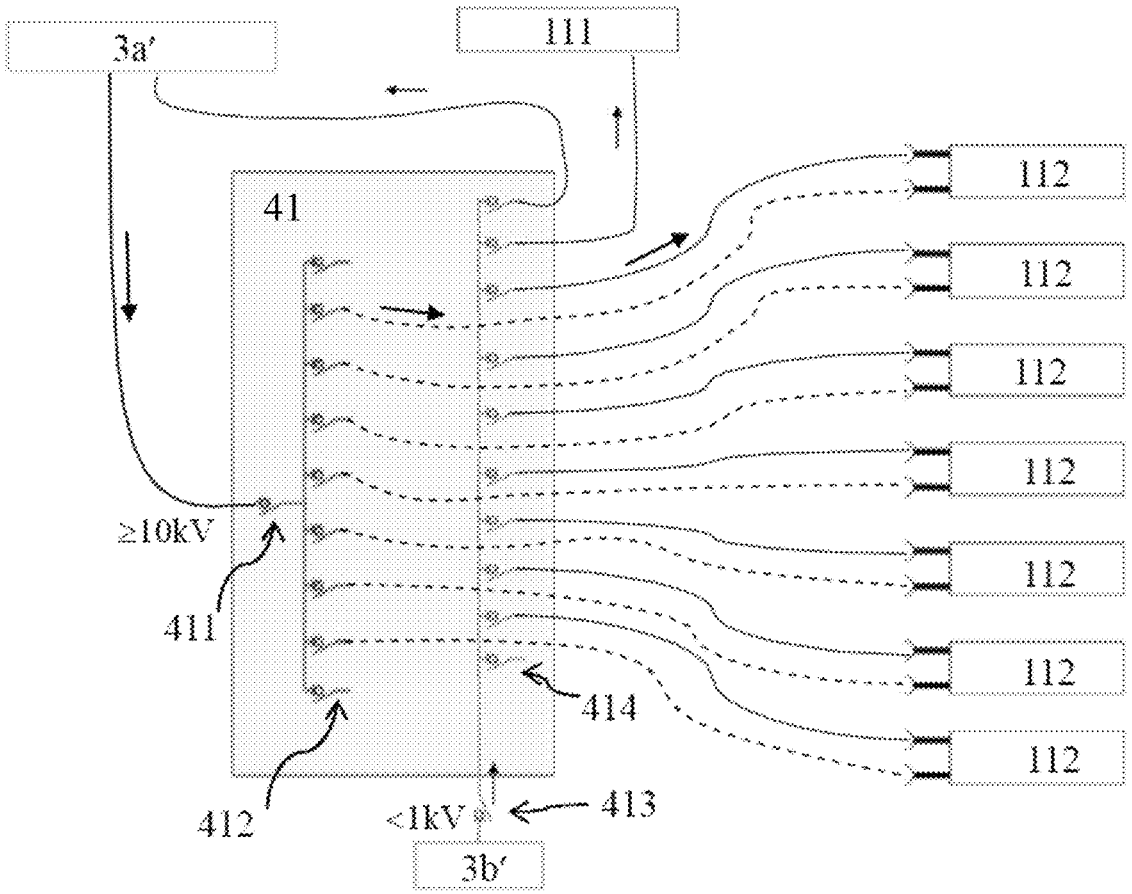
FIG. 3 is a diagram of schematic power supply paths of a pumping system according to one embodiment of the present specification.

FIG. 3 is one example of schematic power supply paths of the pumping system according to the present specification, in which the main power supply system 3*a* adopts a power generator 3*a*' using fuel, and the auxiliary power supply system 3*b* adopts an internal combustion engine generators set 3*b*'. Note that, FIG. 3 corresponds to a case where a plurality of electric fracturing devices is provided in the pumping system as shown in FIG. 2B. The arrows in FIG. 3 show the power supply path.

Figure 6:
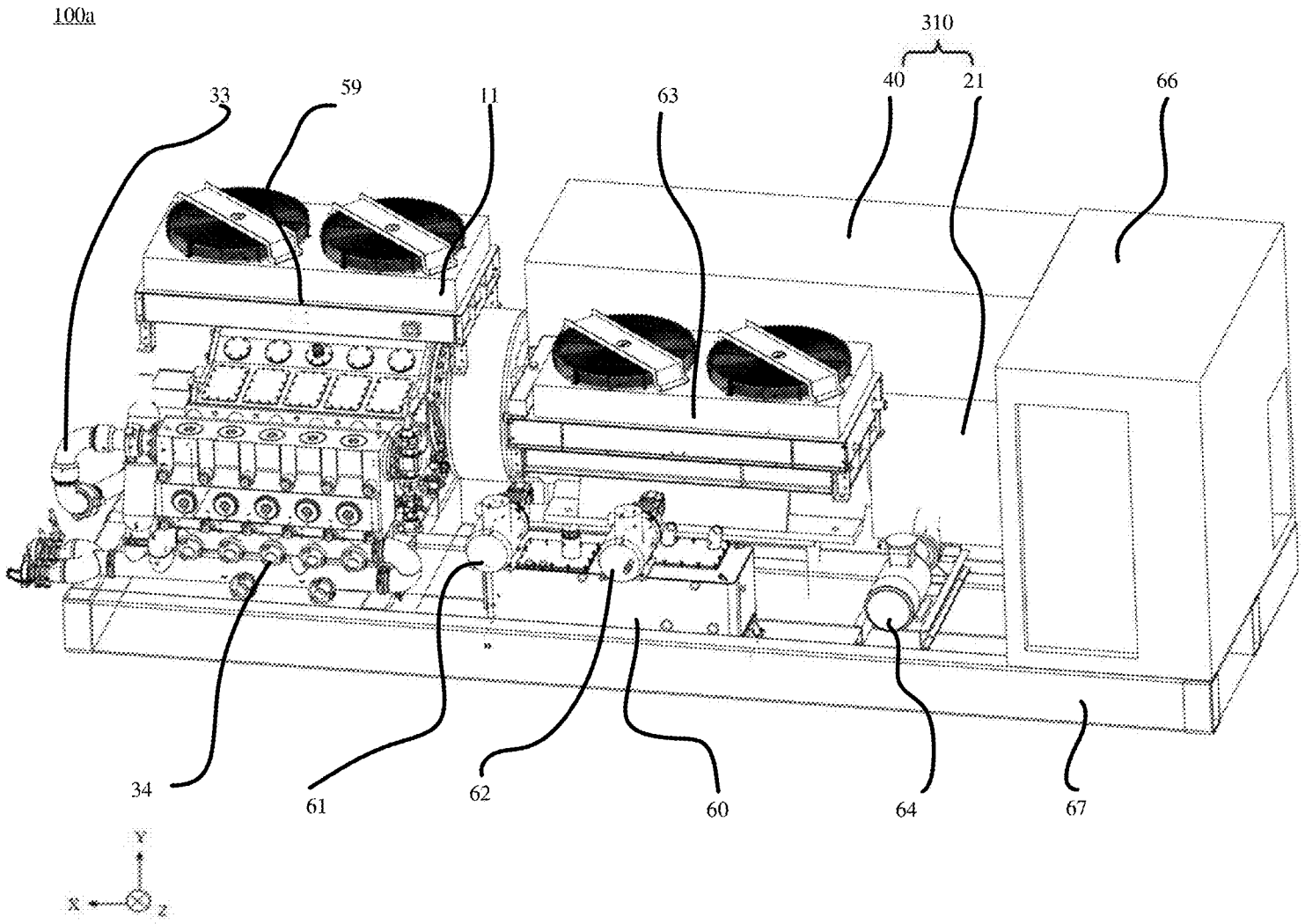
FIG. 6 is a perspective diagram of an electric fracturing device integrated on a supporting frame according to one embodiment of the present specification.

Specifically, the schematic power supply path as shown in FIG. 3 includes a fuel supply hub 111, the power generator 3*a*' using fuel, the internal combustion engine generators set 3*b*', a switch cabinet trailer 41 and at least one (FIG. 3 shows (but is not limited to) seven) electric fracturing device trailer 112. Each of electric fracturing device trailers 112 is loaded with at least one electric fracturing device 8 (which may be also referred to, for example, an electric fracturing device 100*a* as shown in FIG. 6 described later). Each of electric fracturing device trailers 112 has two sets of incoming lines, one set of the incoming lines (e.g., the dash lines) is used to supply electric power to the main motor in the electric fracturing device, another set of the incoming lines (e.g., the solid lines) is used to supply electric power to at least one auxiliary electric device in the electric fracturing device.

In the example of FIG. 3, although a fuel supply path is not shown, the fuel supply hub 111 supplies the fuel to the power generator 3*a*' using fuel. Furthermore, the main power distribution system 4*a* (for example, referring to FIG. 2B) includes a first switch 411, a first transmission cable connected to the first switch 411, and a plurality of second switch 412 connected to the first transmission cable which are provided on the switch cabinet trailer 41, and the auxiliary power distribution system 4*b* (for example, referring to FIG. 2B) includes a third switch 413, a second transmission cable connected to the third switch 413, and a plurality of fourth switch 414 connected to the second transmission cable which are provided on the switch cabinet trailer 41.

The power generator 3*a*' using fuel is a device that converts combustion energy of fuel into mechanical energy and generates electric power by using the mechanical energy, supplies the generated electric power (for example, 10 kV or more) to the first transmission cable via the first switch 411, and then supplies to the electric fracturing device (e.g., the main motor of the electric fracturing device) on the corresponding electric fracturing device trailer 112 or other devices from the first transmission cable via the plurality of second switch 412. Some second switches 412 having not been used yet in FIG. 3 may be used as spare switches that would be connected to other devices. As the example of the plurality of second switch 412, FIG. 3 shows (for example, but is not limited to) nine second switches 412.

The internal combustion engine generators set 3*b*' generates the electric power by using an internal combustion engine to drive a power generator, supplies the generated electric power (for example, 1 kV or less) to the second transmission cable via the third switch 413, and then supplies it to the electric fracturing device (specifically, at least one auxiliary electric device in the electric fracturing device) on the corresponding electric fracturing device trailer 112 or other devices from the second transmission cable via the plurality of fourth switch 414. Furthermore, the internal combustion engine generators set 3*b*' can also supply power to the power generator 3*a*' using fuel, so as to replace the traditional black start operation. In addition, the internal combustion engine generators set 3*b*' can also supply power to the fuel supply hub 111. Some fourth switches 414 having not been used yet in FIG. 3 may be used as a spare switch that would be connected to other devices. As the example of the plurality of fourth switch 414, FIG. 3 shows (for example, but is not limited to) ten fourth switches 414.

The auxiliary power supply system in this example can supply power to the main power supply system, and this procedure of supplying power may be continuous. Since both the main power supply system and the auxiliary power supply system in this example generate the electric power by using the power generators, the present specification solves the problem of most of oil-gas field wellsites lacking a power grid due to their location at a remote place.

Figure 4:
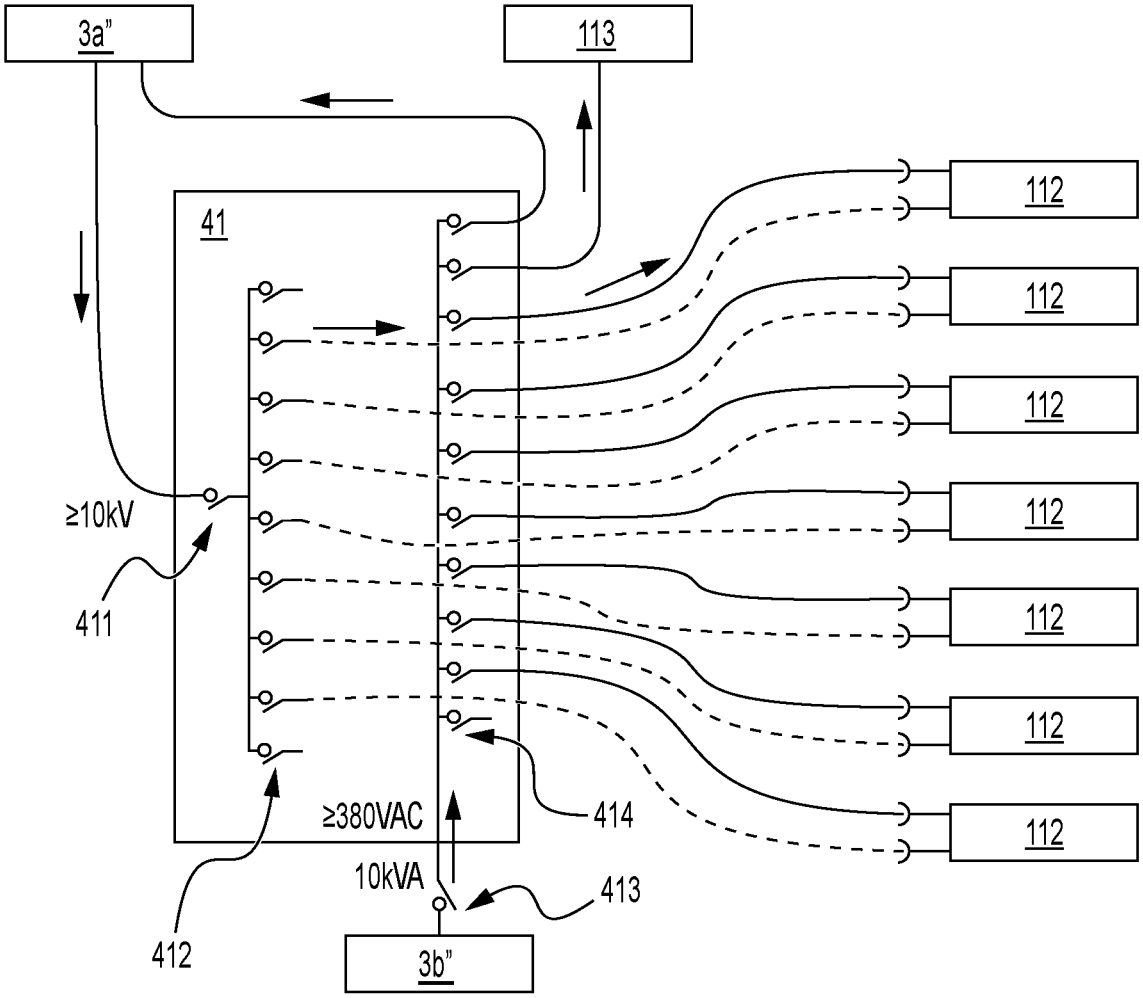
FIG. 4 is a diagram illustrating example schematic power supply paths of a pumping system according to one embodiment of the present specification.

FIG. 4 is one modification of the schematic power supply paths as shown in FIG. 3, in which the main power supply system 3*a* and the auxiliary power supply system 3*b* adopts a gas turbine power generator 3*a*" and a gas turbine power generator 3*b*", respectively. Correspondingly, the gas transported from the gas supplying hub 113 and/or after being processed is supplied to the gas turbine power generators 3*a*" and 3*b*". According to the present modification, the gas may be a natural gas, which provides a more economical and environmental solution than other fuels. In some embodiments, in the idle stage of the fracturing operation, the gas turbine power generator 3*a*" as the main power supply system may be stopped. In some embodiments, the gas turbine power generator 3*b*" can supply an alternating current of 380V or more to the second transmission cable via an auxiliary transformer (for example, with a specification of capacity of 10 kVA). This auxiliary transformer may be omitted. Other aspects are similar to FIG. 3, and the detailed description is omitted.

Figure 5A:
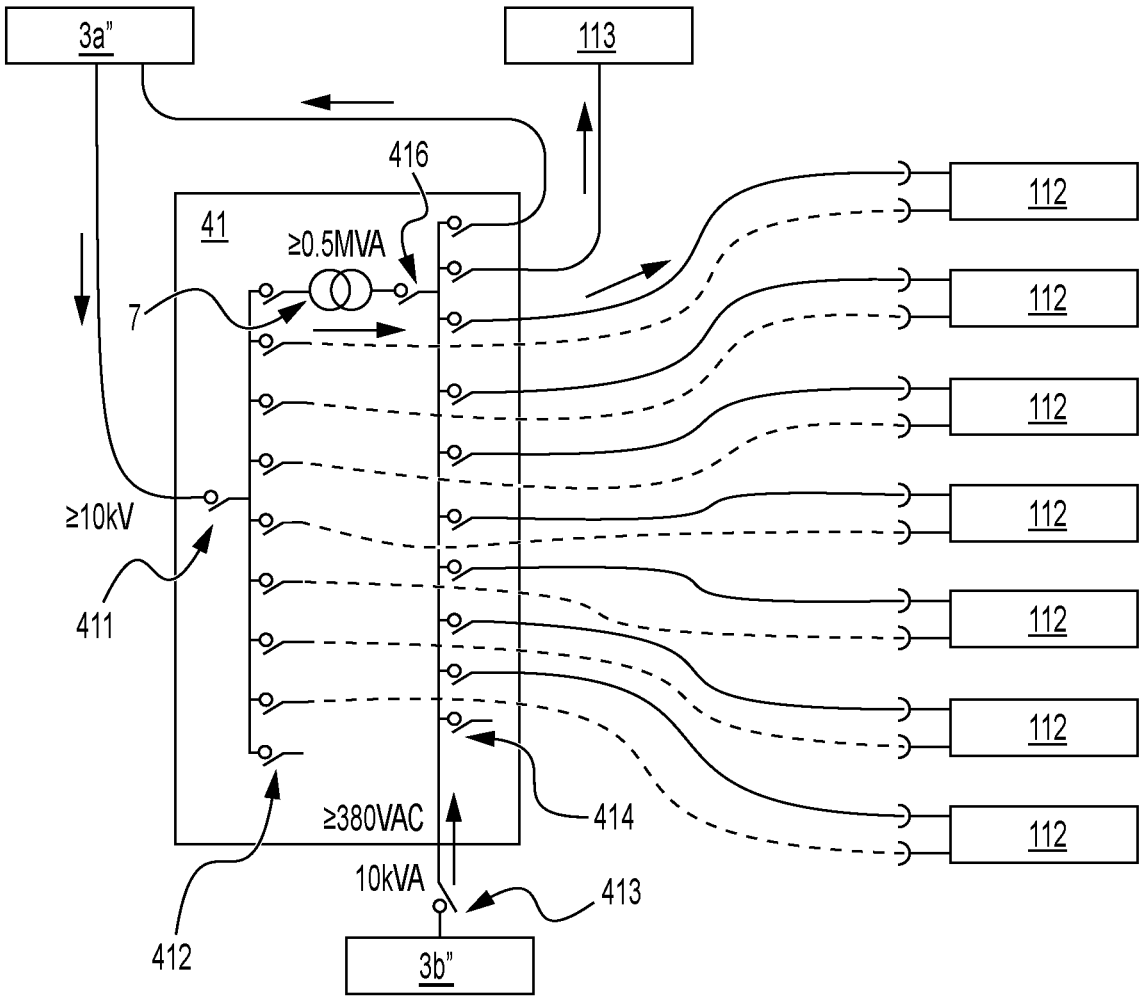
FIG. 5A is a diagram illustrating example schematic power supply paths of a pumping system according to one embodiment of the present specification.

FIG. 5A is another example of the schematic power supply path of the pumping system according to an embodiment of the present specification. FIG. 5A differs from FIG. 4 in that, a transformer 7 (main transformer) and a fifth switch 416 are provided between one of the second switches 412 of the first transmission cable and the second transmission cable. The electric power supplied to the first transmission cable by the gas turbine power generator 3*a*" may be supplied to the second transmission cable via the second switch 412, the transformer 7 and the fifth switch 416, and then is supplied to at least one auxiliary electric device in the electric fracturing devices via the plurality of fourth switches 414. The capacity of the transformer 7 may be 0.5 MVA or more. Such a transformer can transform the power of a high voltage source to be the power of a low voltage source so as to supply it to the auxiliary electric device(s), improving the safety of electricity usage of the wellsite. As mentioned above, since two-path power supplying to the auxiliary electric device(s) is implemented, the selectable channels of electricity usage are increased, and the flexibility of electricity usage is improved. In the present specification, the set of the transformer 7 and the fifth switch 416 connected between a second switch 412 on the first transmission cable and the second transmission cable is not limited to one.

Figure 5B:
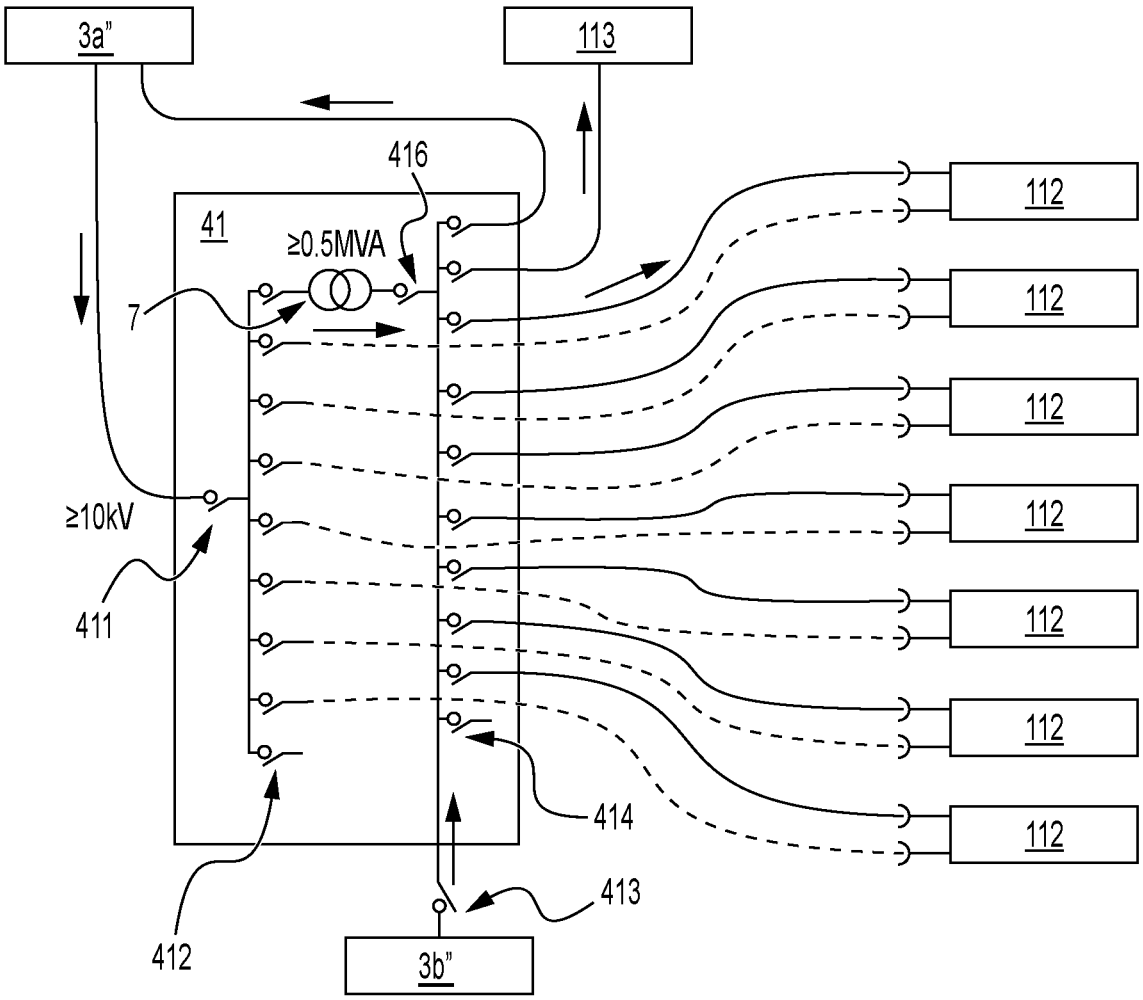
FIG. 5B is a diagram illustrating example schematic power supply paths of a pumping system according to one embodiment of the present specification.

FIG. 5B is one modification of the schematic power supply paths as shown in FIG. 5A. In FIG. 5B, the auxiliary power supply system 3*b* is an energy storing device 3*b*" ", or is a combination of an energy storing device 3*b*" and a power generator (not shown). The energy storing device 3*b*" may be charged with energy in advance. The energy storing device 3*b*"' may store electric power from the power generator combined with the energy storing device, and thus the power generator can achieve the optimum efficiency of power supplying. In some embodiments, when the generated power of the power generator is larger than the power of electricity usage (for example, a set value) of an electric device, a portion of the power generated by the power generator may be stored in the energy storing device. When the power of electricity usage of the electric device exceeds the set value, the energy storing device can supply the stored power to outside, so as to satisfy a provisional demand of excess electricity usage.

The above switches 411, 412, 413, 414, 416 and the transformer 7 may be controlled by a control system (for example, referring to various control systems 81, 82, 83, 84, 85 and the like in FIG. 12) to be described later, so as to flexibly allocate power supply and achieve the flexible selection of electricity usage.

In the present specification, the power supply to at least one auxiliary electric device 6 or other electric devices from the auxiliary power supply system 3*b* and the power supply to the main motor 5 from the main power supply system 3*a* may be at the same time or may be not at the same time. In some embodiments, the power supply from the auxiliary power supply system 3*b* may start earlier. For example, in a case where the main power supply system 3*a* is a gas turbine power generator, the auxiliary power supply system 3*b* can firstly supply power to the gas turbine (its turbine) of this gas turbine power generator, so as to start this gas turbine power generator to operate. For example, when the gas turbine power generator is operating, the auxiliary power supply system 3*b* can constantly supply power to the gas turbine of this gas turbine power generator, so as to prevent the gas turbine from being damaged due to an abnormal shutdown caused by a power failure.

In some embodiments, the power supply to at least one auxiliary electric device 6 by the auxiliary power supply system 3*b* and the power supply to at least one auxiliary electric device 6 by the main power supply system 3*a* may be at the same time or may be not at the same time. In some embodiments, the power supply to at least one auxiliary electric device 6 from the auxiliary power supply system 3*b* may be selected with a superiority (e.g., take priority) to the power supply to at least one auxiliary electric device 6 from the main power supply system 3*a*. The term "superiority" herein means that: the power supplied to the auxiliary electric device 6 by the main power supply system 3*a* is used as a backup power of the power supplied to the auxiliary electric device 6 by the auxiliary power supply system 3*b*. Only when the auxiliary power supply system 3*b* cannot normally supply its power, the power supplied to the auxiliary electric device 6 by the main power supply system 3*a* is kicked in under a switching control.

In FIG. 3 to FIG. 5B, if each of electric fracturing device trailers 112 is loaded with a plurality of electric fracturing devices 8, each of the electric fracturing devices 8 may be provided with two sets of wiring terminals, wherein one set of wiring terminals of the first electric fracturing device 8 is electrically connected to the power supply systems 3*a*, 3*b* via a high-voltage incoming line and a low-voltage incoming line and respectively receives the electric power from the power supply systems 3*a* and 3*b*. Another set of wiring terminals of the first electric fracturing device 8 is used to supply power to the adjacent/next one (e.g., the second electric fracturing device 8) of the electric fracturing devices 8. One set of wiring terminals of the second electric fracturing device 8 receives the electric power from the adjacent electric fracturing device 8 (i.e., the first electric fracturing device 8), and another set of wiring terminals of the second electric fracturing device 8 is used to supply power to the adjacent/next one (e.g., the third electric fracturing device 8) of the electric fracturing devices 8, and so on. Accordingly, it is possible to achieve a direct power supply to the plurality of electric fracturing devices 8 only by one high-voltage incoming line and one low-voltage incoming line, and thus the circuit connection is simplified and it may be installed quickly. Of course, the plurality of electric fracturing devices 8 may separately receive the electric power from the power supply systems 3*a* and 3*b*, so that any electric fracturing device can separately give an alarming, be repaired or be replaced when it fails.

[3. An Integrated Electric Fracturing Device and a Power Supply Circuit Thereof]

FIG. 6 is a perspective diagram of an electric fracturing device integrated on a supporting frame of an example electric fracturing device according to one embodiment of the present specification. The electric fracturing device 100*a* as shown in FIG. 6 includes a variable-frequency and adjustable-speed integrated machine and a plunger pump driven by this variable-frequency and adjustable-speed integrated machine.

Specifically, as shown in FIG. 6, the electric fracturing device 100*a* includes: a supporting frame 67; a variable-frequency and adjustable-speed integrated machine 310 installed on the supporting frame 67; and a plunger pump 11 installed on the supporting frame 67 and integrally connected to the variable-frequency and adjustable-speed integrated machine 310. The variable-frequency and adjustable-speed integrated machine 310 includes an electric motor 21 and a VFD (variable-frequency driving) system 40 integrally installed on the electric motor 21. The VFD system 40 may be an inverter device, or may include a rectifier device and an inverter device, or may include a rectifier device, a filtering device and an inverter device. The transmission output shaft of the electric motor 21 in the variable-frequency and adjustable-speed integrated machine 310 may be (e.g., directly) connected to the transmission input shaft of the plunger pump 11 of the electric fracturing device 100*a*. These two shafts may be connected by a spline. For example, the transmission output shaft of the electric motor 21 may have an internal spline or external spline or flat key or cone key, and the transmission input shaft of the plunger pump 11 may have an external spline or internal spline or flat key or cone key matched with the above spline. The transmission output shaft of the electric motor 21 may have a housing for protection, and the transmission input shaft of the plunger pump 11 may have a housing for protection. These two housings can be fixedly connected together by means of screw, bolt, riveting, welding, flange or the like. The flange may have a circular or square shape and the like.

In FIG. 6, the direction of the transmission output shaft of the electric motor 21 extending horizontally (the direction from the variable-frequency and adjustable-speed integrated machine 310 towards the plunger pump 11) is the X direction, the upward direction perpendicular to the X direction is the Y direction, and the inward direction orthogonal to both the X direction and Y direction and perpendicular to the sheet of FIG. 6 is the Z direction.

The electric fracturing device 100*a* may also include a control cabinet 66. For example, the control cabinet 66 is disposed at one end of the variable-frequency and adjustable-speed integrated machine 310 in the −X direction, and the plunger pump 11 of the electric fracturing device 100*a* is disposed at another end of the variable-frequency and adjustable-speed integrated machine 310 in the X direction. The present specification is not limited to the relative positions of the control cabinet 66, the variable-frequency and adjustable-speed integrated machine 310 and the plunger pump 11 as shown in FIG. 6, as long as their assembly is capable of providing highly-integrated the electric fracturing device 100*a*. The electric power transmitted from the main power supply system 3*a* may be directly supplied to the variable-frequency and adjustable-speed integrated machine 310, or may be supplied to the variable-frequency and adjustable-speed integrated machine 310 via the control cabinet 66 (without being processed in the control cabinet or after being processed in the control cabinet). Furthermore, the electric power transmitted from the main power supply system 3*a* and the auxiliary power supply system 3*b* may be supplied to other auxiliary electric devices in the electric fracturing device 100*a* other than the variable-frequency and adjustable-speed integrated machine 310 via the control cabinet 66. For example, the control cabinet 66 may include a power distribution system and a control system, for distributing power to any electric device (s) in the electric fracturing device 100*a* and may output information such as voltage, power, failure and the like of the electric fracturing device 100*a* to outside for controlling the electric fracturing device 100*a*. For example, a main switch cabinet, a main transformer, an auxiliary switch cabinet, an auxiliary transformer and the like may be integrally provided in the control cabinet 66. The main switch cabinet and the main transformer can control and adjust the electric power transmitted from the main power supply system 3*a* so as to supply it to the variable-frequency and adjustable-speed integrated machine 310 in the electric fracturing device 100*a* or other auxiliary electric devices. The auxiliary switch cabinet and the auxiliary transformer can control and adjust the electric power transmitted from the auxiliary power supply system 3*b* so as to supply it to other auxiliary electric devices in the electric fracturing device 100*a* other than the variable-frequency and adjustable-speed integrated machine 310. As one example, the auxiliary transformer can output a low voltage of 220V-500V (alternating current) so as to supply electric power to the auxiliary electric devices such as a lubricating system, a heat dissipation system and a control system in the electric fracturing device 100*a*.

The electric fracturing device 100*a* may also include at least one of the following: a lubricating system; a lubrication oil heat dissipation system; and a coolant heat dissipation system, and the like. The lubricating system, for example, includes: a lubrication oil tank 60; a first lubricating motor 61; and a second lubricating motor 62 and the like. The electric fracturing device 100*a* may be provided with different lubrication pumps in accordance with different lubrication positions, and the pumps are driven by the first lubricating motor 61 or the second lubricating motor 62, so as to satisfy lubrication demands for various pressures, flow rates or oil products. The lubrication oil heat dissipation system may include a lubrication oil heat dissipater 59 and the like for cooling the lubrication oil. The coolant heat dissipation system may include a coolant heat dissipater 63 and a heat dissipating motor 64 and the like for reducing the temperature of the high-voltage variable-frequency integrated machine 310. The above lubrication oil heat dissipation system and the coolant heat dissipation system may be integrally disposed on the top or a side of the plunger pump 11, or may be integrally disposed on the top or a side of the high-voltage variable-frequency integrated machine 310, so that it is possible to achieve the high integration of the overall assembly of the fracturing device 100*a* at the same time of fully achieving a heat dissipation ability. Similarly, the above lubricating system may be integrally disposed on a side of the high-voltage variable-frequency integrated machine 310. Hereinafter, the first lubricating motor 61, the second lubricating motor 62 and the heat dissipating motor 64 are collectively called as auxiliary motors 61, 62 and 64 if there is no need to distinguishing them from each other. Thus, the auxiliary electric device in the electric fracturing device 100*a*, may include: a lubricating motor, a heat dissipating motor, and a control system provided in the control cabinet, and the like.

The rated frequency of the variable-frequency and adjustable-speed integrated machine 310 may be 50 Hz or 60 Hz, which is the same as the power supply frequency of a power supply system such as a power grid. In this case, the variable-frequency and adjustable-speed integrated machine 310 may be directly connected to the power supply system such as the power grid without via a transformer. Therefore, the power supply is simplified and the adaptation ability is stronger.

In some embodiments, the whole electric fracturing device 100*a* adopts the variable-frequency and adjustable-speed integrated machine 310, and the external wiring of this variable-frequency and adjustable-speed integrated machine 310 can be directly connected to the main power supply system without a transformer for adjusting the voltage from the power supply system. The plunger pump 11 of the electric fracturing device 100*a* is driven by the variable-frequency and adjustable-speed integrated machine 310 so as to pump a fracturing liquid to the underground. The present specification is not limited to use the variable-frequency and adjustable-speed integrated machine 310 as an electric driving device, and an electric driving device in which the VFD system 40 and the electric motor 21 are separately installed may be used. For example, the VFD system 40 may be installed in the control cabinet. The VFD system 40 may be only partially (for example, the inverter device thereof) integrated on the electric motor 21.

A fluid feeding manifold (a low pressure manifold) 34 may be provided at one side of the plunger pump 11 in the −Z direction, for supplying the fracturing liquid to a fluid inlet (not shown) of the plunger pump 11. A fluid discharging manifold (high pressure manifold) 33 may be provided at least one end of the plunger pump 11 in the X direction and/or −X direction, for discharging the fracturing liquid from a fluid outlet (not shown) of the plunger pump 11. The fracturing liquid from the fluid feeding manifold 34 enters into inside of the plunger pump 11 via the fluid inlet of the plunger pump 11, is pressurized by the movement of the plunger pump 11, then is discharged from the fluid outlet of the plunger pump 11 to a high pressure pipe outside the plunger pump 11 via the fluid discharging manifold 33, and then enters into the underground or the wellhead so as to perform a fracturing operation.

In the electric fracturing device 100*a* as shown in FIG. 6, the supporting frame 67 may be replaced with a skid chassis or a semitrailer (or trailer). A plurality of electric fracturing devices 100*a* can be integrated on one supporting frame 67 or one set of supporting frames 67 (or skid chassis(es) or semitrailer(s)).

Figure 7:
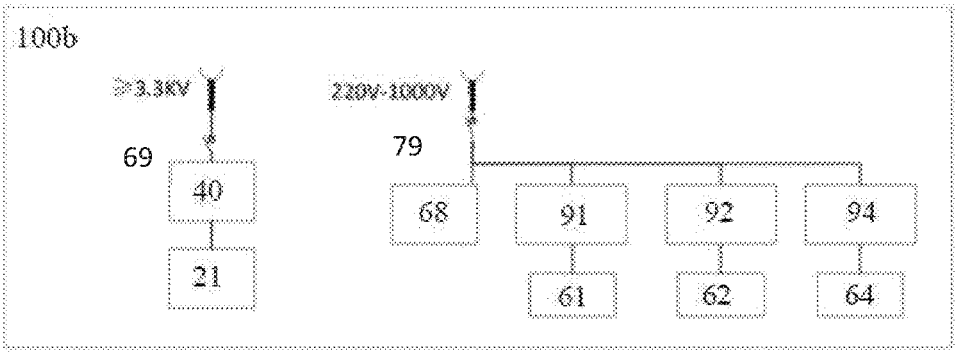
FIG. 7 is a schematic block diagram of power supply paths of two power supply systems used in the electric fracturing device according to one embodiment of the present specification.

FIG. 7 is a schematic block diagram of power supply paths of two power supply systems used in the electric fracturing device according to the present specification.

The electric fracturing device 100*b* in FIG. 7, similar to the electric fracturing device 100*a* in FIG. 6, includes: a main motor 21 for driving the plunger pump (not shown); a VFD system 40 connected at the upstream of the main motor 21 so as to adjust the frequency of the main motor 21; a first lubricating motor 61 for driving a first lubrication oil pump (not shown); a second lubricating motor 62 for driving a second lubrication oil pump (not shown); a heat dissipating motor 64 for driving a coolant pump (not shown); and a control system 68 provided in a control cabinet (referring to the control cabinet 66 in FIG. 6). Furthermore, the electric fracturing device 100*b* in FIG. 7 further includes: a VFD system 91 connected at the upstream of the first lubricating motor 61 so as to adjust the frequency of the first lubricating motor 61; a VFD system 92 connected at the upstream of the second lubricating motor 62 so as to adjust the frequency of the second lubricating motor 62; and a VFD system 94 connected at the upstream of the heat dissipating motor 64 so as to adjust the frequency of the heat dissipating motor 64. In some embodiments, the VFD systems 40, 91, 92, 94 may be disposed separately from the corresponding electric motors 21, 61, 62, 64. In some embodiments, similarly to the VFD system 40 which is integrated on the main motor 21 as shown in FIG. 6, VFD systems 40, 91, 92, 94 as shown in FIG. 7 may be at least partially integrated on electric motors 21, 61, 62, 64, respectively.

When an on/off switch 69 is turned on, a main power supply system supplies, for example, a high voltage of 3.3 kV or more to a main motor 21 via a high-voltage incoming line and a VFD system 40, and a plunger pump is driven by the main motor 21 so as to achieve the stepless speed regulation of the plunger pump, so that the operating liquid is pumped into a well shaft after being pressurized. When an on/off switch 79 is turned on, an auxiliary power supply system supplies, for example, a low voltage of 220V-1000V to a control system 68 via a low-voltage incoming line, and the auxiliary power supply system also supplies the low voltage to auxiliary motors 61, 62, 64 via low-voltage incoming lines and VFD systems 91, 92, 94 respectively. Auxiliary motors 61, 62, 64 achieve functions of lubrication, heat dissipation and the like by driving the corresponding lubrication oil pump or coolant pump.

Note that, the above auxiliary motors are not limited to the aforementioned first lubricating motor 61, the second lubricating motor 62 and the heat dissipating motor 64.

Figure 8:
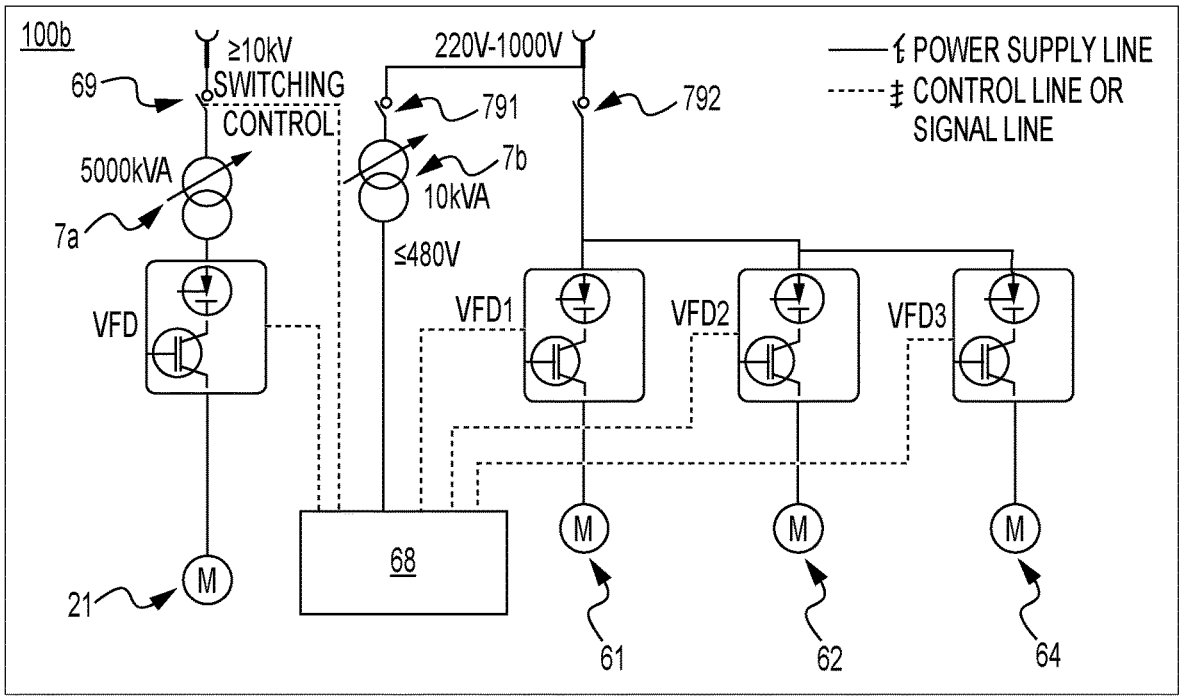
FIG. 8 is a circuit diagram of an example power supply according to one embodiment of the present specification.

FIG. 8 shows one example of a circuit diagram for achieving the power supply paths as shown in FIG. 7.

In the electric fracturing device 100*b* as shown in FIG. 8, a main power supply system (for example, ≥10 kV), an on/off switch 69, a high-power transformer 7*a* (for example, 3000 kVA-7000 kVA), a variable-frequency drive VFD and a main motor 21 are successively electrically connected. An auxiliary power supply system (for example, 220V-1000V), an on/off switch 791, a low-power transformer 7*b* (for example, 0-10 kVA) (if necessary) and a control system 68 are successively electrically connected. Furthermore, through an on/off switch 792, the auxiliary power supply system also supplies the electric power to auxiliary motors 61, 62, 64 via variable-frequency drives VFD1, VFD2 and VFD3 respectively.

Variable-frequency drives VFD, VFD1, VFD2 and VFD3 may correspond to the above VFD systems 40, 91, 92, 94. Variable-frequency drives VFD, VFD1-VFD3 each may include IGBT power modules. A signal communication is performed between the control system 68 and the on/off switch 69 and between the control system 68 and variable-frequency drives VFD and VFD1-VFD3.

When the on/off switch 69 is turned on in accordance with a control signal from the control system 68, the main power supply system supplies, for example, the voltage of 10 kV or more to the high-power transformer 7*a* for regulating the voltage, and the regulated voltage is supplied to the main motor 21 after its frequency is adjusted by the VFD system. When the on/off switch 69 is turned off, the main power supply system stops supplying electric power.

When the on/off switch 791 is turned on, the auxiliary power supply system supplies, for example, the voltage of 220V-1000V to the low-power transformer 7*b* for regulating the voltage, and the regulated voltage (for example, ≤480V) is supplied to the control system 68. When the on/off switch 791 is turned off, the auxiliary power supply system stops supplying electric power to the control system 68. The low-power transformer 7*b* is not necessarily needed.

Furthermore, when the on/off switch 792 is turned on, the auxiliary power supply system supplies, for example, the voltage of 220V-1000V to the variable-frequency drives VFD1, VFD2, VFD3 for adjusting the frequency, and the adjusted voltage is respectively supplied to the auxiliary motors 61, 62, 64. When the on/off switch 792 is turned off, the auxiliary power supply system stops supplying electric power to the auxiliary motors 61, 62, 64.

Therefore, through the control system 68, the present specification can control the on/off switch 69 on the high-voltage incoming line and each of the variable-frequency drives. In a case of an emergency shutoff, the control system 68 of the electric fracturing device 100*b* can receive an instruction from an instrumentation apparatus (not shown in FIG. 8) and thus the on/off switch 69 is turned off, thereby achieving the emergency stop of the electric fracturing device 100*b*.

Figure 9:
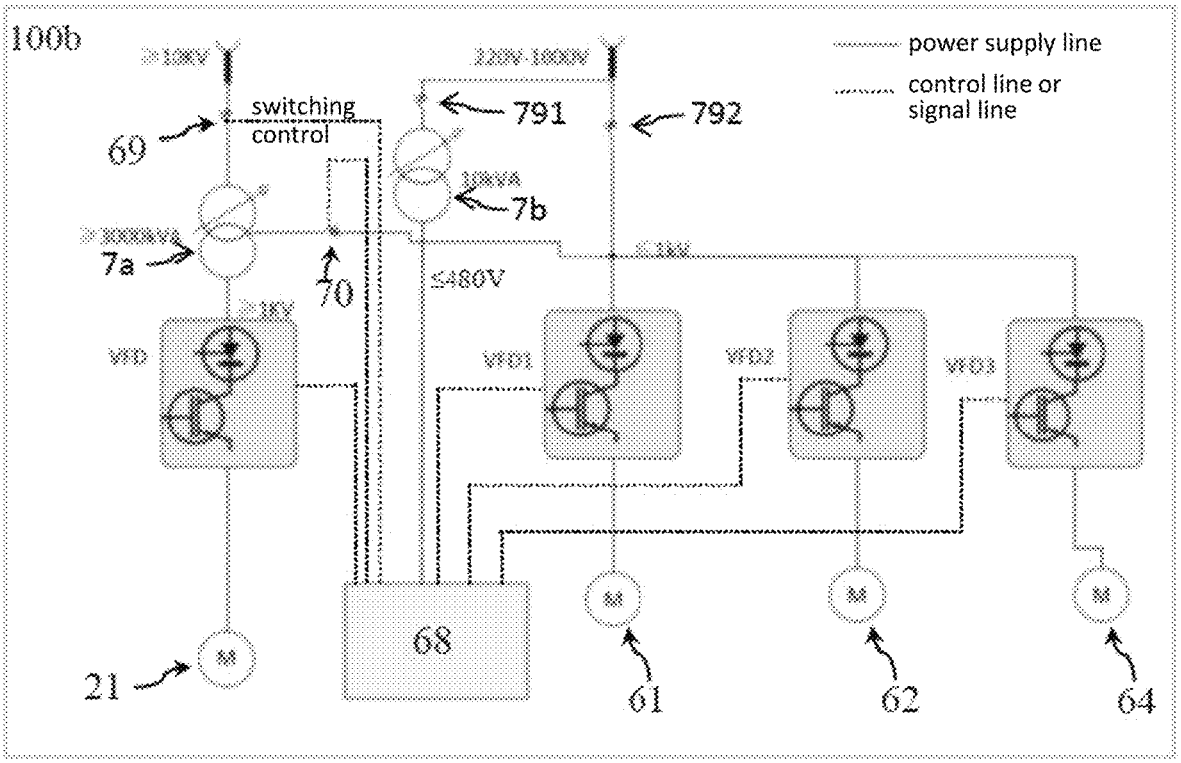
FIG. 9 is a circuit diagram of an example power supply according to one embodiment of the present specification.

FIG. 9 is one modification of the circuit diagram as shown in FIG. 8.

FIG. 9 differs from FIG. 8 in that the main power supply system further supplies electric power to the auxiliary motors 61, 62, 64 via a tap of the high-power transformer 7*a* and an on/off switch 70 connected to the tap. Specifically, when the on/off switch 70 is turned on, the voltage output from the main power supply system via the tap of the high-power transformer 7*a* is supplied to the auxiliary motors 61, 62, 64 via the variable-frequency drives VFD1, VFD2 and VFD3, respectively. Thus, by using a tap, the high-power transformer 7*a* provides two different voltages to the main variable-frequency drive VFD and the auxiliary variable-frequency drives VFD1, VFD2, VFD3, and it is possible to provide two-path power supplied to the auxiliary motors 61, 62, 64, and to improve the stability of electricity usage of the auxiliary electric devices. By using the control system 68 which performing an on/off control for the on/off switch 70, it is possible that the power supply from the auxiliary power supply system to the auxiliary electric device is selected with a superiority to the power supply from the main power supply system to the auxiliary electric device.

Although the solution in which one variable-frequency drive corresponds to one electric motor is described in FIG. 7 to FIG. 9, a solution in which one variable-frequency drive corresponds to a plurality of electric motors may be employed in other application.

In some embodiments, the auxiliary power supply system further supplies electric power to the main power supply system, and the startup time of the auxiliary power supply system is earlier than the startup time of the main power supply system.

In each of aforementioned embodiments of the present specification, the example of the pumping system including the electric fracturing device is described. The working fluid of the electric fracturing device may be a fracturing liquid. The fluid feeding manifold supplies the fracturing liquid to the fluid inlet of the plunger pump, the fracturing liquid is pressurized by the plunger pump and then is discharged to the fluid discharging manifold via the fluid outlet, and then is transported to the underground to fracture the formation.

In addition to or in replace of the electric fracturing device, the pumping system may include an electric pumping device. The working fluid of the electric pumping device may be a pumping liquid. The fluid feeding manifold supplies the pumping liquid to the fluid inlet of the plunger pump, and the pumping liquid is pressurized by the plunger pump and then is discharged to the fluid discharging manifold via the fluid outlet, and then is transported to a downhole to pump a downhole tool (for example, transfer it down) or to drive the downhole tool.

In addition to or in replace of the electric fracturing device, the pumping system may include an electric cementing device. The working fluid of the electric cementing device may be a cement paste. The fluid feeding manifold supplies the cement paste to the fluid inlet of the plunger pump, the cement paste is pressurized by the plunger pump and then is discharged to the fluid discharging manifold via the fluid outlet, and then is transported into at least one mineshaft so as to fix the wall of the mineshaft.

[4. A Wellsite Assembly and Control Systems Thereof]

FIG. 10 shows an example wellsite assembly including a plurality of electric fracturing devices according to the present specification. FIG. 11 is a schematic block diagram corresponding to the wellsite assembly as shown in FIG. 10. The example in which the plunger pump 11 of each of the electric fracturing devices 100*a* is equipped with the fluid feeding manifold 34 and the fluid discharging manifold 33 has been described with reference to FIG. 6. However, as shown in FIG. 10 and FIG. 11, a plurality of electric fracturing devices 100*a* are included in this wellsite assembly, the fluid inlet of the plunger pump of each of the plurality of electric fracturing devices 100*a* is equipped with its own fluid feeding manifold 34, and the fluid outlet of the plunger pump of each of the plurality of electric fracturing devices 100*a* shares one fluid discharging manifold 33. A fracturing liquid with a low pressure is transported into the fluid inlet of the plunger pump of each electric fracturing device 100*a* via the corresponding fluid feeding manifold 34. The fracturing liquid is pressurized by the plunger pump which is driven by the main motor so as to obtain the fracturing liquid with a high pressure. The obtained fracturing liquid is transported to the common fluid discharging manifold 33 via the fluid outlet of the plunger pump, and then is injected into the wellhead(s) 18 via the fluid discharging manifold 33, so as to enter the formation of an oil well or a gas well and to fracture the formation. The manifolds may be integrated on one or one set (one or more) manifold skid chassis, or may be integrated on one manifold semitrailer, so as to be collectively monitored and managed.

The wellsite assembly further includes a fluid preparing region. The fluid preparing region may include a sand supplying device (also referred to as a proppant supplying device) 72, a liquid supplying device 73, a mixing device 74, an adding device 75 and a sand blender 76 and the like. In some cases, the fracturing liquid injected into the downhole is a sand-carrying liquid, and thus there is a need to mix water, sand, chemical additive and the like so as to make sand suspend in the fracturing liquid. For example, the liquid supplying device 73 can directly derive the fluid transported by a transport vehicle, or may include a plurality of fluid containers for storing liquid. A liquid such as clean water may be supplied to the mixing device 74 via the liquid supplying device 73, and a reagent such as chemical additive may be supplied to the mixing device 74 via the adding device 75. The clean water and the chemical additive may be mixed in the mixing device 74 so as to form a mixture liquid (a fracturing base solution). The mixture liquid in the mixing device 74 and the sand in the sand supplying device 72 may enter (generally at different times, and via different inlets) into the sand blender 76 for mixing, and form a sand-carrying fracturing liquid during a fracturing operation. The fracturing liquid with a low pressure formed by the sand blender 76 is transported to the fluid inlet of the plunger pump 11 of each of electric fracturing devices 100*a* via the fluid feeding manifold 34.

In some embodiments, the adding device 75 can directly supply a reagent such as a chemical additive to the sand blender 76 without via the mixing device 74, or if necessary, the adding device 75 can supply reagents to the mixing device 74 and the sand blender 76. In some embodiments, the liquid supplying device 73 can supply the liquid to the sand blender 76 via or without via the mixing device 74. In some embodiments, the sand blender 76 may be connected to arbitrary combinations of the sand supplying device 72, the liquid supplying device 73, the mixing device 74 and the adding device 75, and can receive the supply from these arbitrary combinations as necessary.

When the liquid supplying device 73 and the adding device 75 directly add the water and the chemical additive into the sand blender 76 rather than into the mixing device 74, in this case, the mixing device 74 may be omitted. In some cases, the adding device 75 may be omitted. In the present specification, the above sand supplying device 72, the liquid supplying device 73, the mixing device 74, the adding device 75 and the sand blender 76 are provided needed and may be omitted in some instances, and their functions, numbers, modes of combination and assemblies may be selected and designed according to specific demands of the working fluid. For example, at least a portion of the mixing device 74 may be integrated with the sand blender 76.

The wellsite assembly further includes a power generating and supplying region. In some embodiments, in a case where the power generating and supplying region includes a power generator using fuel, the wellsite assembly may also include a fuel transport device 51 and a pressure regulating device 53 and/or a gasification device 55 (which will be described later with reference to FIG. 13) for processing the fuel. In some embodiments, in a case where a wellhead gas or a pipeline gas is used for generating power in the power generating and supplying region, the wellsite assembly may also include a purifying equipment 54 (which will be described later with reference to FIG. 13 and FIG. 14). The pressure regulating device 53, the purifying equipment 54, the gasification device 55 each may be provided inside or outside the power generating and supplying region.

The power generating and supplying region may include the main power supply system 3*a* and the auxiliary power supply system 3*b* as described above. The main power supply system 3*a* supplies electric power to the main electric device in the wellsite, for example, mainly supplies electric power to the electric motor for driving the plunger pump in the electric fracturing device. The auxiliary power supply system 3*b* supplies electric power to the auxiliary electric device in the wellsite, for example, mainly supplies electric power to the auxiliary electric devices such as the heat dissipating motor, the lubricating motor, an illuminating system, a sensing system and the control system in the electric fracturing device. As mentioned above, the auxiliary power supply system 3*b* can supply power to the main power supply system 3*a*. As mentioned above, when the auxiliary power supply system 3*b* fails, the main power supply system 3*a* can supply power to the auxiliary electric device in the wellsite. In some cases, the power generating and supplying region may also include the switch cabinet trailer 41 as described above.

The wellsite assembly may be provided with an instrumentation apparatus 71, which can remotely control the electric fracturing device 100*a*, the fluid preparing region, the power generating and supplying region and the like. The remote control may be achieved by a wired communication or a wireless communication.

In some embodiments, the instrumentation apparatus 71, the sand supplying device 72, the liquid supplying device 73, the mixing device 74, the adding device 75, the sand blender 76 and the like may use the electric power supplied from the main power supply system 3*a*.

In some embodiments, the switch cabinet trailer 41, if present, may include arbitrary combinations of the following: a main switch, a main transformer and a main variable-frequency drive equipped for the main power supply system 3*a*, and an auxiliary switch, an auxiliary transformer, an auxiliary variable-frequency drive equipped for the auxiliary power supply system 3*b*, and the like. The main variable-frequency drive and the auxiliary variable-frequency drive each may be an inverter unit or may be a combination of an inverter unit, a rectifier unit and a filtering unit. The combination of the main switch, the main transformer and the main variable-frequency drive constitutes the main power distribution system of the switch cabinet trailer 41. The combination of the auxiliary switch, the auxiliary transformer and the auxiliary variable-frequency drive constitutes the auxiliary power distribution system of the switch cabinet trailer 41. The main switch, main transformer, main variable-frequency drive, auxiliary switch, auxiliary transformer, auxiliary variable-frequency drive and the like may be integrated on one semitrailer (or trailer). The main power supply system 3*a* may be a gas turbine power generator, which includes a gas turbine engine and a power generator. The gas turbine power generator directly generates a high voltage that is transported in multi paths to the plurality of electric fracturing devices 100*a*, the instrumentation apparatus 71 and the fluid preparing region through the main switch, the main transformer and the main variable-frequency drive and the like on the switch cabinet trailer 41. The auxiliary power supply system 3*b* may be a power-generating equipment, which generates a low voltage that is transported in multi paths to the plurality of electric fracturing devices 100*a* through the auxiliary switch, the auxiliary transformer and the auxiliary variable-frequency drive and the like on the switch cabinet trailer 41.

FIG. 12 shows an example of various control systems in the wellsite assembly according to the present specification. In FIG. 12, the wellsite assembly includes an instrumentation apparatus 71, a main power supply system 31*a*, an auxiliary power supply system 31*b*, an electric fracturing device trailer 112 and a power distribution apparatus 42. The instrumentation apparatus 71 includes a centralized control system 81, the main power supply system 31*a* includes a main power supply system control system 82, the auxiliary power supply system 31*b* includes an auxiliary power supply system control system 84, the electric fracturing device trailer 112 includes an electric fracturing device control system 83, and the power distribution apparatus 42 includes a power distribution apparatus control system 85. In the wellsite assembly as shown in FIG. 12, a video system 86 and a sensor system 87 are further provided. The video system 86, for example, includes at least one video acquisition camera. The sensor system 87, for example, includes at least one sensor.

The instrumentation apparatus 71 provided in the wellsite is provided with the centralized control system 81 therein, and the centralized control system includes a plurality of modules for input, output, calculation, display, communication and storage, and can communicate with the control systems in each of the main/auxiliary power supply system, the electric fracturing device, and the power distribution apparatus, so as to achieve the remote centralized control of the main/auxiliary power supply system, the electric fracturing device and the power distribution apparatus. The centralized control system may also utilize the video acquisition camera and the sensors provided at various positions of the wellsite to achieve a video acquisition for the important positions of the wellsite and an acquisition for the environmental parameters such as temperature, smog, gas content and the like in those regions.

Through the instrumentation apparatus 71, it is possible to achieve an emergency shutdown or emergency shutoff of the above main/auxiliary power supply system, the electric fracturing device and the power distribution apparatus. When a certain sensor detects a fuel gas content out of limit, or when the main/auxiliary power supply system gives a high-level alarming such as overcurrent, overvoltage or overtemperature, the instrumentation apparatus 71 can display an alarm information such as voice or image in time, so as to facilitate the operator to make a judgement on implementing the emergency shutdown or shutoff of a certain kind of devices or a certain device or all devices. In some embodiments, by utilizing a cooperation between the above control systems, the emergency shutdown or shutoff of a certain kind of devices or a certain device or all devices may be achieved through an automatic judgement of the pumping system.

The wellsite assembly described above is also applicable to a case where the fracturing device is replaced with a pumping device or a cementing device, and the specific assembly may be adaptively changed.

[5. Fuel Supply and Fuel Process]

FIG. 13 shows a schematic block diagram of a supply path for supplying a fuel to a power generator using fuel. In a case where the main power supply system 3*a* and/or auxiliary power supply system 3*b* is a power generator using fuel, as shown in FIG. 13, a transport device 51 and a process device 52 are provided in the supply path of the fuel 50. The fuel 50 is transported to the process device 52 via the transport device 51, is processed by the process device 52 and then is supplied to the engine of each of the main power supply system 3*a* as the main power-generating equipment and/or the auxiliary power supply system 3*b* as the auxiliary power-generating equipment.

Energy generated by the combustion of the fuel drives the engine, and the engine drives the power generator to generate the electric power so as to satisfy the electric power demand in the wellsite. The fuel may be a form of a liquid, a solid, or a gas. When the fuel is a fuel gas, the fuel may be CNG (compressed natural gas), LNG (liquid-state natural gas) or may be for example a wellhead gas or a pipeline gas. When the fuel is CNG, the corresponding process device 52 may include a pressure regulating device 53, CNG is adjusted by the pressure regulating device 53 to reach a certain pressure and then is supplied to the main power-generating equipment 3*a* (for example, the gas turbine of the gas turbine power generator) and the auxiliary power-generating equipment 3*b* (for example, a piston-type internal combustion engine of a piston-type internal combustion engine power generator). When the fuel is LNG, the corresponding process device 52 may include a gasification device 55, LNG is subjected to a gasifying process by the gasification device 55 and then provides a gas fuel for generating the electric power in the main power-generating equipment 3*a* and the auxiliary power-generating equipment 3*b*. When the fuel is a fuel gas such as a wellhead gas or a pipeline gas containing impurities, the corresponding process device 52 may include a purifying equipment 54. Depending on the source and the kind of the fuel 50, the above various process devices may be provided in combination. After the fuel is processed, it is possible to provide the fuel with a certain purification degree and a certain pressure to the engine, thereby satisfying the fuel demands of the main/auxiliary power-generating equipment. The selection of the fuel 50 is flexible, and the present specification allows the wellsite assembly to adapt to different conditions. For example, when the gas turbine power generator is used to replace the traditional diesel generator, it is possible to reduce the discharge of the exhaust gas and reduce the fuel cost.

FIG. 14 shows an example purifying equipment 54 used in the process device 52 as shown in FIG. 13.

When the source of the fuel gas is a wellhead gas or a pipeline gas etc., the purifying equipment 54 is employed in the process device 52 as shown in FIG. 13. As shown in FIG. 14, the purifying equipment 54 includes: a filter 10; a compressor 12; an air cooler 13; a gas-liquid separator 14; a dehydration film separator 15; and a dehydrocarbon film separator 16. Specifically, an inlet of the filter 10 communicates with a pipeline of the wellhead gas, an outlet of the filter 10 is connected to an inlet end of the compressor 12, so as to supply the filtered wellhead gas to the compressor 12. The bottom of the filter 10 is also provided with a liquid or solid discharge port for discharging liquid droplets or solid particles produced during the filtering. An outlet end of the compressor 12 is connected to an inlet of the air cooler 13, an outlet of the air cooler 13 is connected to an inlet of the gas-liquid separator 14. The air cooler 13 cools the gas, which is compressed and then output by the compressor 12, and then supplies it to the gas-liquid separator 14. An outlet of the gas-liquid separator 14 is connected to the inlet of the dehydration film separator 15, the gas-liquid separator 14 performs a gas-liquid separation on the gas from the air cooler 13, and the obtained gas is output to the dehydration film separator 15. The bottom of the gas-liquid separator 14 is also provided with a liquid discharge port for discharging the condensed liquid produced during the gas-liquid separation. The outlet of the dehydration film separator 15 is connected to the inlet of the dehydrocarbon film separator 16. The dehydration film separator 15 and the dehydrocarbon film separator 16 perform a dehydration process and a dehydrocarbon process on the incoming gas, and the purified gas is discharged from the outlet of the dehydrocarbon film separator 16 to outside.

The dehydration film separator 15 is configured to remove water from the gas and may be provided with, for example, two outlets, wherein one outlet is connected to the inlet of the dehydrocarbon film separator 16, and another outlet is communicated with the pipeline of the wellhead gas so that the gas which needs repeated multi-dehydration processes is fed to the pipeline of the wellhead gas again. These two outlets can be separately opened/closed. For example, when the gas needing a repeated dehydration process is fed, the one outlet of the dehydration film separator 15 connected to the inlet of the dehydrocarbon film separator 16 is closed. As necessary, the dehydrocarbon film separator 16 is configured to remove heavy hydrocarbons and may be also provided with two outlets similar to the dehydration film separator 15.

In this way, the purification device for the wellhead gas adopts film separating devices connected in series, and achieves the dehydration process and the dehydrocarbon process by the dehydration film separator and the dehydrocarbon film separator, respectively. The whole purification device has a simplified structure, can be assembled conveniently and has a small footprint area. The purification device does not need additional material and reagent consumption, thereby having a low operation cost. It provides a guarantee that the whole system of the wellsite assembly can have a small footprint area and a reduced operating cost.

The above has described the technique according to the present specification with reference to embodiments and modifications. However, the technique according to the present specification is not limited to the above embodiments and the like, and may be modified in many ways.

What is claimed is:

1. A pumping system, comprising:

an electric fracturing device including: a plunger pump, a main motor for driving the plunger pump, and at least one auxiliary electric device; and multiple power supply systems for supplying electric power to the electric fracturing device, wherein the multiple power supply systems include at least one main power supply and at least one auxiliary power supply, wherein the main power supply supplies electric power to the main motor, the at least one auxiliary power supply supplies electric power to the at least one auxiliary electric device, and wherein the main power supply is configured to supply electric power to the at least one auxiliary electric device, and supplying electric power to the at least one auxiliary electric device from the auxiliary power supply takes priority to supplying electric power to the at least one auxiliary electric device from the main power supply.

2. The pumping system according to claim 1, wherein:

the auxiliary power supply is further configured to supply electric power to the main power supply.

3. The pumping system according to claim 1, wherein:

the main power supply is further configured to supply electric power to the at least one auxiliary electric device via a transformer.

4. The pumping system according to claim 2, wherein:

the main power supply is further configured to supply electric power to the at least one auxiliary electric device via a transformer.

5. The pumping system according to claim 2, comprising:

a plurality of electric fracturing devices including the electric fracturing device;

a first switch having a first terminal and a second terminal, wherein the first terminal of the first switch is electrically connected to the main power supply, a plurality of second switches, each of the second switches having a first terminal and a second terminal, wherein the first terminals of the second switches are electrically connected to the second terminal of the first switch, and each of a portion of the second terminals of the second switches is electrically connected to a main motor of corresponding one of the plurality of the electric fracturing devices, a third switch having a first terminal and a second terminal, wherein the first terminal of the third switch is electrically connected to the auxiliary power supply, and a plurality of fourth switches, each of the fourth switches having a first terminal and a second terminal, wherein the first terminals of the fourth switches are electrically connected to the second terminal of the third switch, and each of a portion of the second terminals of the fourth switches is electrically connected to an auxiliary electric device of corresponding one of the plurality of the electric fracturing devices.

6. The pumping system according to claim 4, comprising:

a plurality of the electric fracturing devices including the electric fracturing device;

a first switch having a first terminal and a second terminal, wherein the first terminal of the first switch is electrically connected to the main power supply, a plurality of second switches, each of the second switches having a first terminal and a second terminal, wherein the first terminals of the second switches are electrically connected to the second terminal of the first switch, and each of a portion of the second terminals of the second switches is electrically connected to a main motor of corresponding one of the plurality of the electric fracturing devices, a third switch having a first terminal and a second terminal, wherein the first terminal of the third switch is electrically connected to the auxiliary power supply, and a plurality of fourth switches, each of the fourth switches having a first terminal and a second terminal, wherein the first terminals of the fourth switches are electrically connected to the second terminal of the third switch, and each of a portion of the second terminals of the fourth switches is electrically connected to an auxiliary electric device of corresponding one of the plurality of the electric fracturing devices.

7. The pumping system according to claim 1, wherein, the main power supply includes at least one of a power grid and a power generator using a fuel, and/or the auxiliary power supply includes at least one of an internal combustion engine generator set, a power grid close to a wellsite, a solar power panel, and an energy storing device.

8. The pumping system according to claim 7, wherein, the main power supply and/or the auxiliary power supply includes a gas turbine power generator, the pumping system further includes a gas supplying device for supplying a fuel gas to the gas turbine power generator, and the auxiliary power supply supplies electric power to the gas supplying device.

9. The pumping system according to claim 1, wherein, the at least one auxiliary electric device includes a control system and a plurality of auxiliary motors, the main power supply is electrically connected to a power input terminal of a first transformer, a power output terminal of the first transformer is electrically connected to a power input terminal of a first variable-frequency drive, and a power output terminal of the first variable-frequency drive is electrically connected to the main motor, the auxiliary power supply is electrically connected to a power input terminal of a second transformer, a power output terminal of the second transformer is electrically connected to the control system, the auxiliary power supply is further electrically connected to a power input terminal of each of a plurality of second variable-frequency drives, a power output terminal of each of the plurality of second variable-frequency drives is electrically connected to corresponding one of the plurality of auxiliary motors, and the control system, based on a power, voltage or current information received from each of the first variable-frequency drive and the plurality of second variable-frequency drives, outputs a control signal to each of the first variable-frequency drive and the plurality of second variable-frequency drives.

10. The pumping system according to claim 9, wherein, a first on/off switch is electrically connected between the main power supply and the power input terminal of the first transformer, the control system performs an on/off switching control of the first on/off switch, and when the first on/off switch is turned on, the main power supply supplies electric power to the main motor, and when the first on/off switch is turned off, the main power supply stops supplying electric power to the main motor.

11. The pumping system according to claim 10, wherein, the first transformer has a tap, a second on/off switch is electrically connected between the tap of the first transformer and the power input terminal of each of the plurality of second variable-frequency drives, the control system performs an on/off switching control of the second on/off switch, and when the second on/off switch is turned on, the main power supply supplies electric power to each of the auxiliary motors, and when the second on/off switch is turned off, the main power supply stops supplying electric power to each of the auxiliary motors.

12. The pumping system according to claim 1, wherein, the plunger pump pressurizes and transports fracturing liquid to underground to fracture a formation.

13. The pumping system according to claim 1, wherein, the plunger pump pressurizes and transports pumping liquid to a downhole to pump or drive a downhole tool.

14. The pumping system according to claim 1, wherein, the plunger pump pressurizes and transports cement paste to at least one mineshaft to fix a wall of the mineshaft.

15. A wellsite assembly comprising:

a pumping system according to claim 1, wherein, when the main power supply and/or the auxiliary power supply uses fuel to generate electric power, the wellsite assembly further comprises a transport device for transporting the fuel and a process device for processing the fuel, and the process device includes at least one of a gas fuel pressure regulating device, a liquid fuel gasification device, or a fuel purification device.

16. A wellsite assembly comprising:

a pumping system according to claim 1, a fluid preparing region comprising:

a sand blender communicating with a fluid inlet of the plunger pump;

a sand supplying device for supplying sand to the sand blender; and a liquid supplying device for supplying a liquid to the sand blender, wherein the sand blender mixes the sand from the sand supplying device with the liquid from the liquid supplying device, to obtain working fluid and supply the working fluid to the fluid inlet of the plunger pump.

17. A wellsite assembly according to claim 16, wherein the fluid preparing region further comprises:

a mixing device; and an adding device for supplying a chemical additive to the sand blender, wherein the liquid from the liquid supplying device and the chemical additive from the adding device are mixed by the mixing device and supplied to the sand blender.

18. A wellsite assembly including:

an electric fracturing device including: a plunger pump, a main motor for driving the plunger pump, and at least one auxiliary electric device; and multiple power supply systems for supplying electric power to the electric fracturing device, wherein the multiple power supply systems include at least one main power supply and at least one auxiliary power supply, wherein the main power supply supplies electric power to the main motor, the at least one auxiliary power supply supplies electric power to the at least one auxiliary electric device, wherein the plunger pump has a fluid feeding manifold communicating with its own fluid inlet, and a fluid outlet of the plunger pump shares an fluid discharging manifold communicating with a wellhead, and the fluid feeding manifold and the fluid discharging manifold are integrated on at least one manifold-integrating equipment.

19. A wellsite assembly including:

a pumping system according to claim 1;

an instrumentation apparatus and a centralized control system provided in the instrumentation apparatus;

a control system provided in the main power supply;

a control system provided in the auxiliary power supply;

a control system provided in the electric fracturing device;

a power distribution apparatus and a control system provided in the power distribution apparatus, wherein the main power supply and the auxiliary power supply supply electric power to the electric fracturing device via the power distribution apparatus;

a video system for capturing video in a wellsite; and a sensor system for acquiring an environmental parameter in a wellsite, wherein the sensor system, the video system, the control system in the power distribution apparatus, the control system in the electric fracturing device, the control system in the auxiliary power supply and the control system in the main power supply each respectively feeds information to the centralized control system and is respectively provided with a control signal by the centralized control system.

20. A wellsite assembly according to claim 19, wherein, by using a cooperation of the control system in the power distribution apparatus, the control system in the electric fracturing device, the control system in the auxiliary power supply and the control system in the main power supply with the centralized control system, a selection and control for supplying electric power to the electric fracturing device from the main power supply and the auxiliary power supply is implemented.

21. A wellsite assembly according to claim 19, wherein, the centralized control system is a remote control system, and when the electric fracturing device fails, the control system in the electric fracturing device transports an alarm information corresponding to this failure to the remote control system, and the remote control system performs a remote reset on the electric fracturing device.

22. A method for controlling a pumping system, wherein, the pumping system comprises:

an electric fracturing device or a pumping device or a cementing device including: a plunger pump; a main motor for driving the plunger pump; and at least one auxiliary electric device; and multiple power supply systems for supplying electric power to the electric fracturing device or the pumping device or the cementing device, and including at least one main power supply and at least one auxiliary power supply, and the method comprises:

supplying electric power to the main motor by using the main power supply, and supplying electric power to the at least one auxiliary electric device by using the auxiliary power supply, and before the main power supply is started and when the main power supply supplies electric power, continuously supplying electric power to the main power supply by using the auxiliary power supply.

23. The method according to claim 22, further comprising:

supplying electric power to the at least one auxiliary electric device via a transformer by using the main power supply, wherein, when supplying electric power to the at least one auxiliary electric device from the auxiliary power supply fails, the main power supply is used to supply electric power to the at least one auxiliary electric device.

* * * * *